US012025132B1

(12) United States Patent
Florindez

(10) Patent No.: US 12,025,132 B1
(45) Date of Patent: Jul. 2, 2024

(54) PUMP HAVING ROTOR MEMBER WITH AXIALLY SLIDING VANES AND A ONE-WAY CHECK VALVE

(71) Applicant: Augusto Florindez, La Mirada, CA (US)

(72) Inventor: Augusto Florindez, La Mirada, CA (US)

( * ) Notice: Subject to any disclaimer, the term of this patent is extended or adjusted under 35 U.S.C. 154(b) by 45 days.

(21) Appl. No.: 16/440,753

(22) Filed: Jun. 13, 2019

(51) Int. Cl.
*F04C 2/344* (2006.01)
*F04C 28/28* (2006.01)

(52) U.S. Cl.
CPC ..... *F04C 2/3448* (2013.01); *F04C 2/344* (2013.01); *F04C 28/28* (2013.01); *F04C 2210/1094* (2013.01)

(58) Field of Classification Search
CPC .. F04C 2/344; F04C 28/28; F04C 2210/1094; F04C 2/3448; F01C 1/3448; F01C 2/344
See application file for complete search history.

(56) References Cited

U.S. PATENT DOCUMENTS 1,743,977 A * 1/1930 Petersen ..... F04C 2/3448 418/219
2,020,611 A * 11/1935 Knapp ..... F01C 1/3448 418/219
2,154,456 A * 4/1939 Knapp ..... F04C 2/3448 418/219
2,154,457 A * 4/1939 Knapp ..... F04C 2/3448 418/219
3,160,110 A 12/1964 Budzich
3,838,954 A * 10/1974 Rapone ..... F04C 2/44 418/188
4,183,723 A * 1/1980 Hansen ..... F04C 14/02 417/204
4,424,236 A 1/1984 Campbell
4,568,257 A * 2/1986 Moore ..... F04C 15/066 418/173
4,948,611 A 8/1990 Cummins
5,046,940 A 9/1991 Cummings
5,270,070 A 12/1993 Campbell
5,350,290 A 9/1994 Honings
5,356,652 A 10/1994 Campbell
6,303,168 B1 10/2001 Campbell
7,140,853 B2 * 11/2006 Al Hawaj ..... F01C 1/3448 418/219
8,790,099 B2 * 7/2014 Qu ..... F04C 18/332 418/173
2012/0171337 A1 7/2012 Campbell et al.

* cited by examiner

*Primary Examiner* — Mary Davis
*Assistant Examiner* — Paul W Thiede

(57) ABSTRACT

A pump for fluid material includes a housing and a rotor member within the housing mounted to rotate between a passageway end plate and a drive end plate each having inward facing cam surfaces. The housing, plates, and rotor member in assembly form a passageway between a passageway cam surface and a first side of the rotor member. This places the passageway's intake opening and discharge opening in communication with each other along the passageway. The rotor member's vane elements are configured to slide laterally and move reciprocally as the rotor member rotates, moving the fluid material being fed into the intake opening, through the passageway, and finally out the discharge opening.

2 Claims, 24 Drawing Sheets

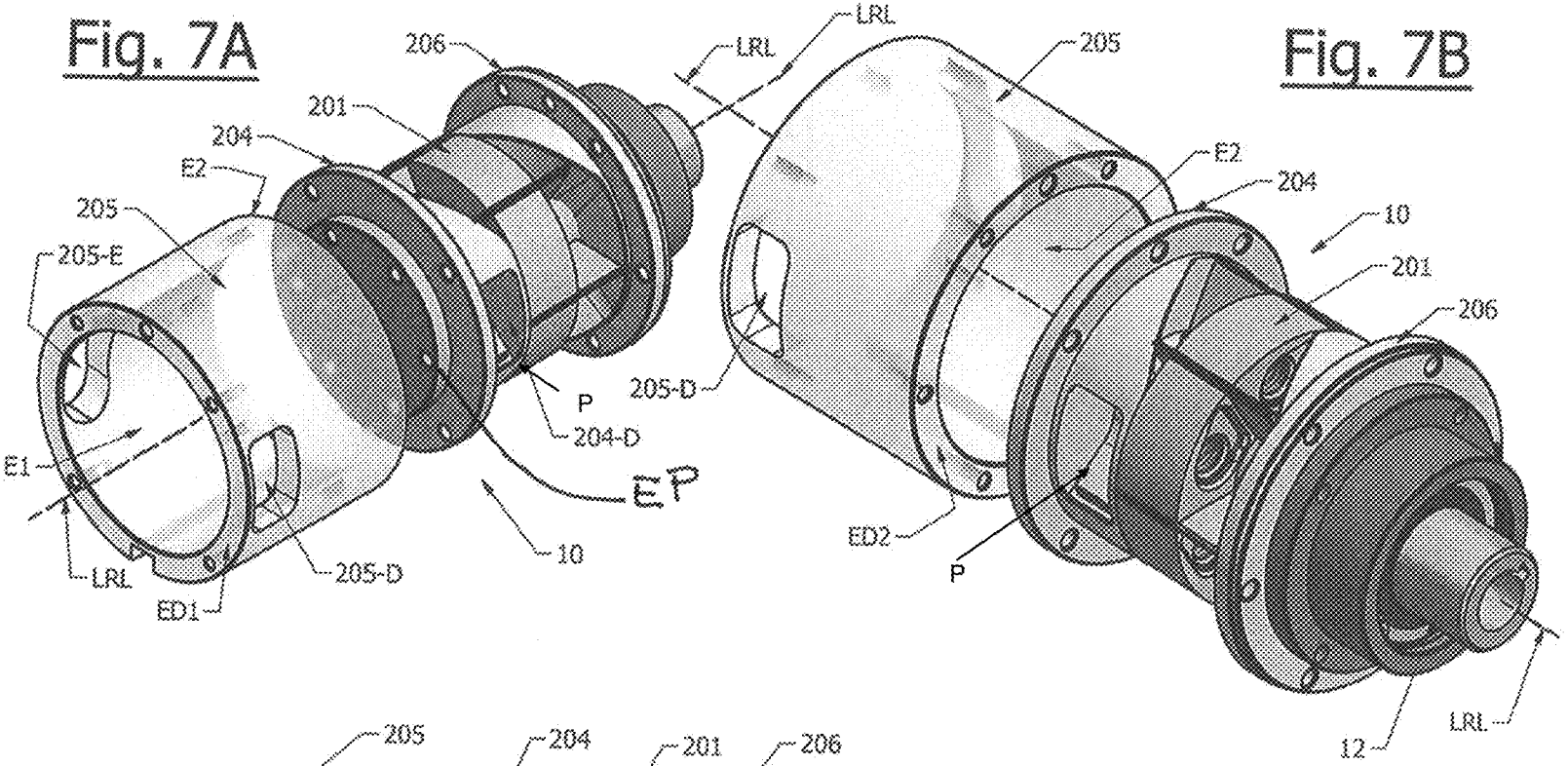
Fig. 7B
Fig. 7A
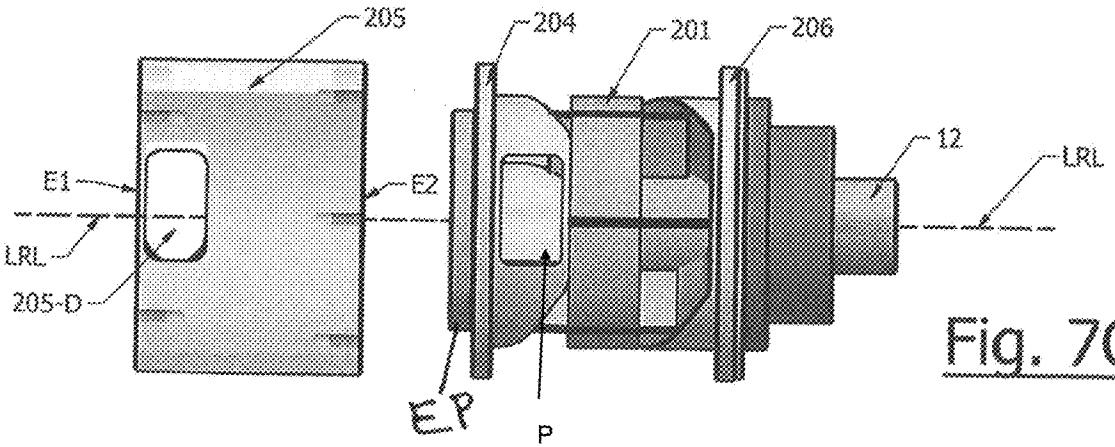
Fig. 7C 10
12
LRL
E1
E2
EP
H3
H4
201
204
205
205D
205E
206

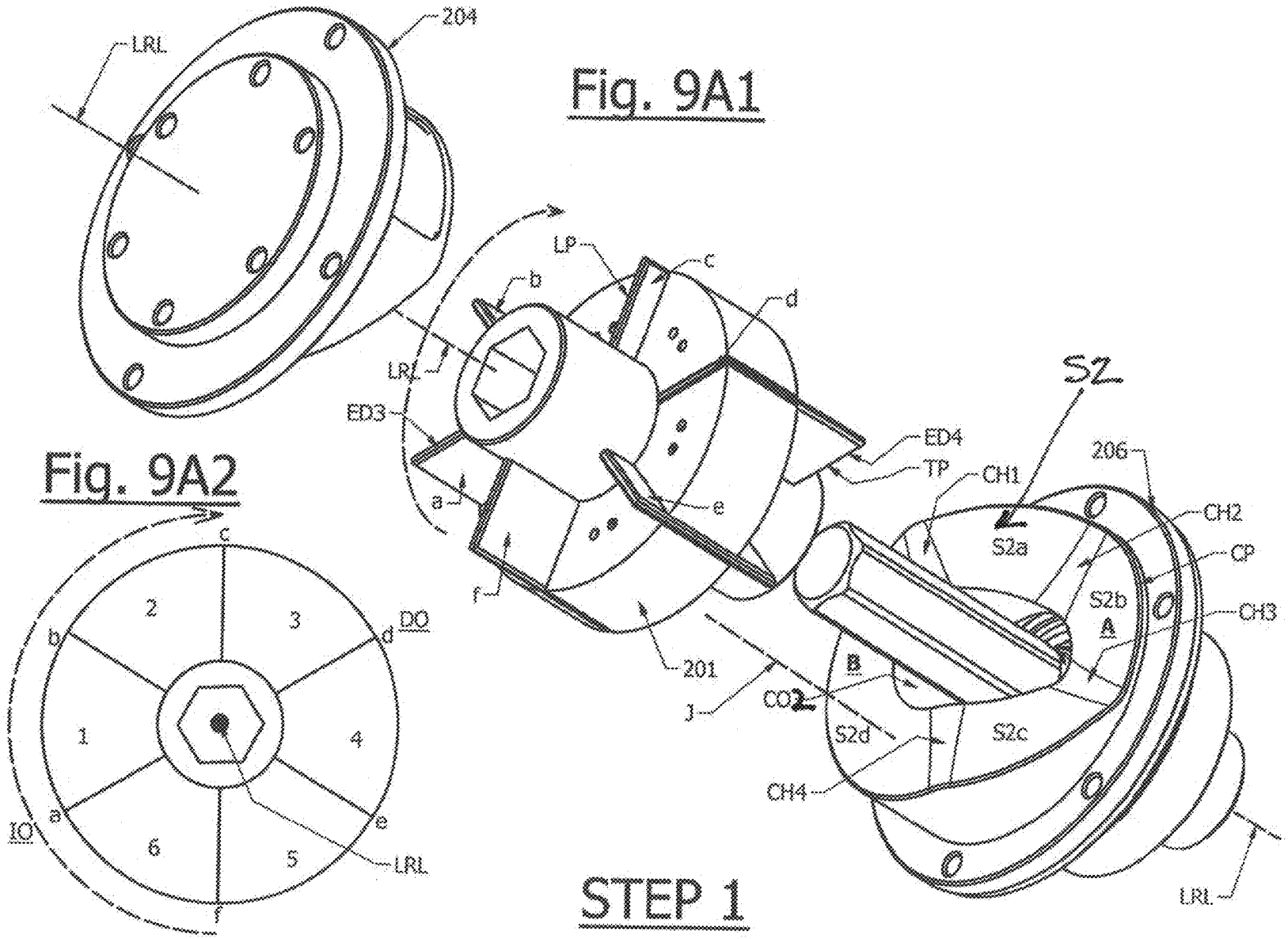
Fig. 9A1
STEP 1
Fig. 9A2
SZ
204
LRL
206
CH2
CP
CH3
S2b
A
S2a
S2c
CH1
ED4
TP
B
S2d
CO2
CH4
J
201
d
c
e
LP
b
LR
ED3
a
f
DO
IO
1
2
3
4
5
6

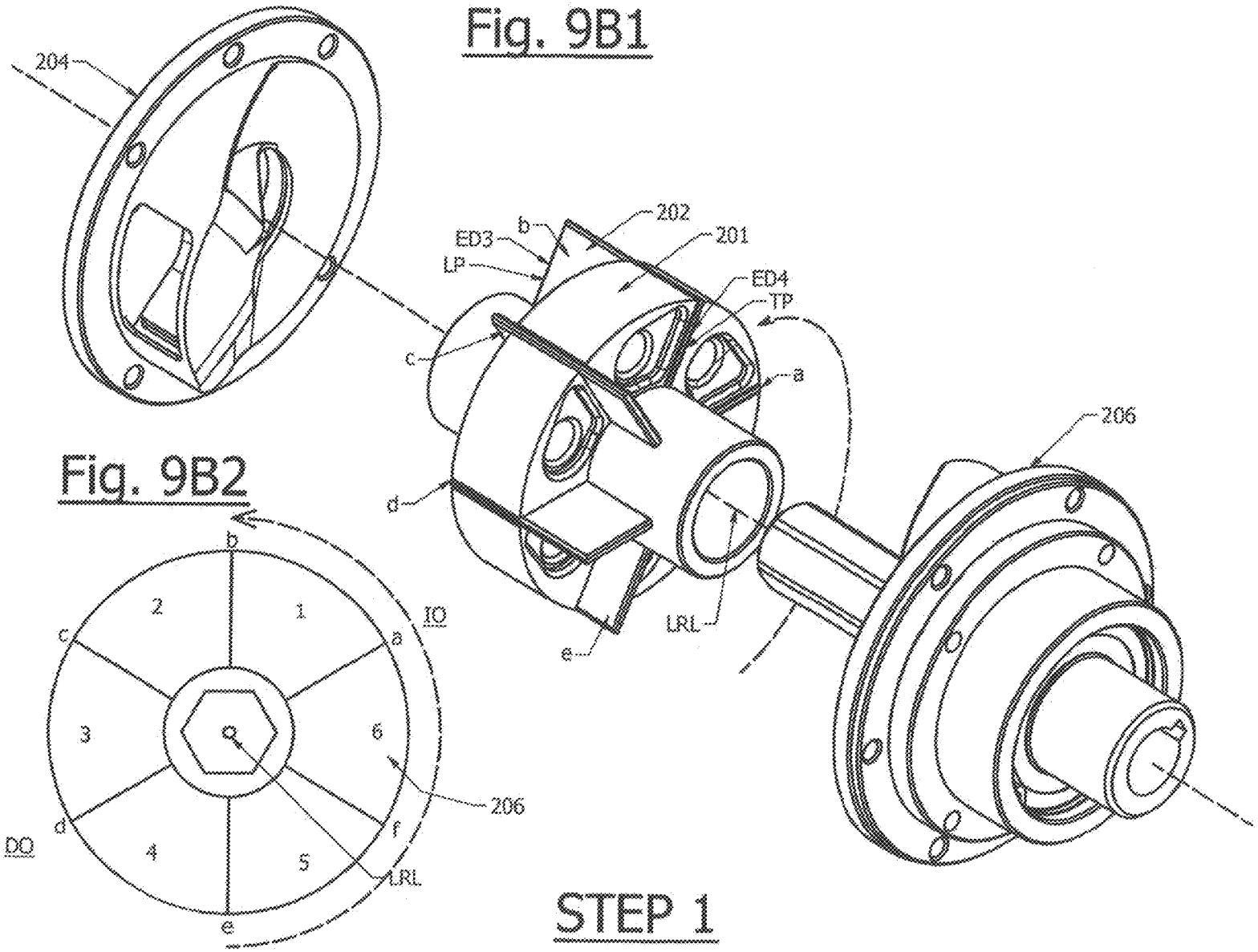
Fig. 9B1
Fig. 9B2
STEP 1

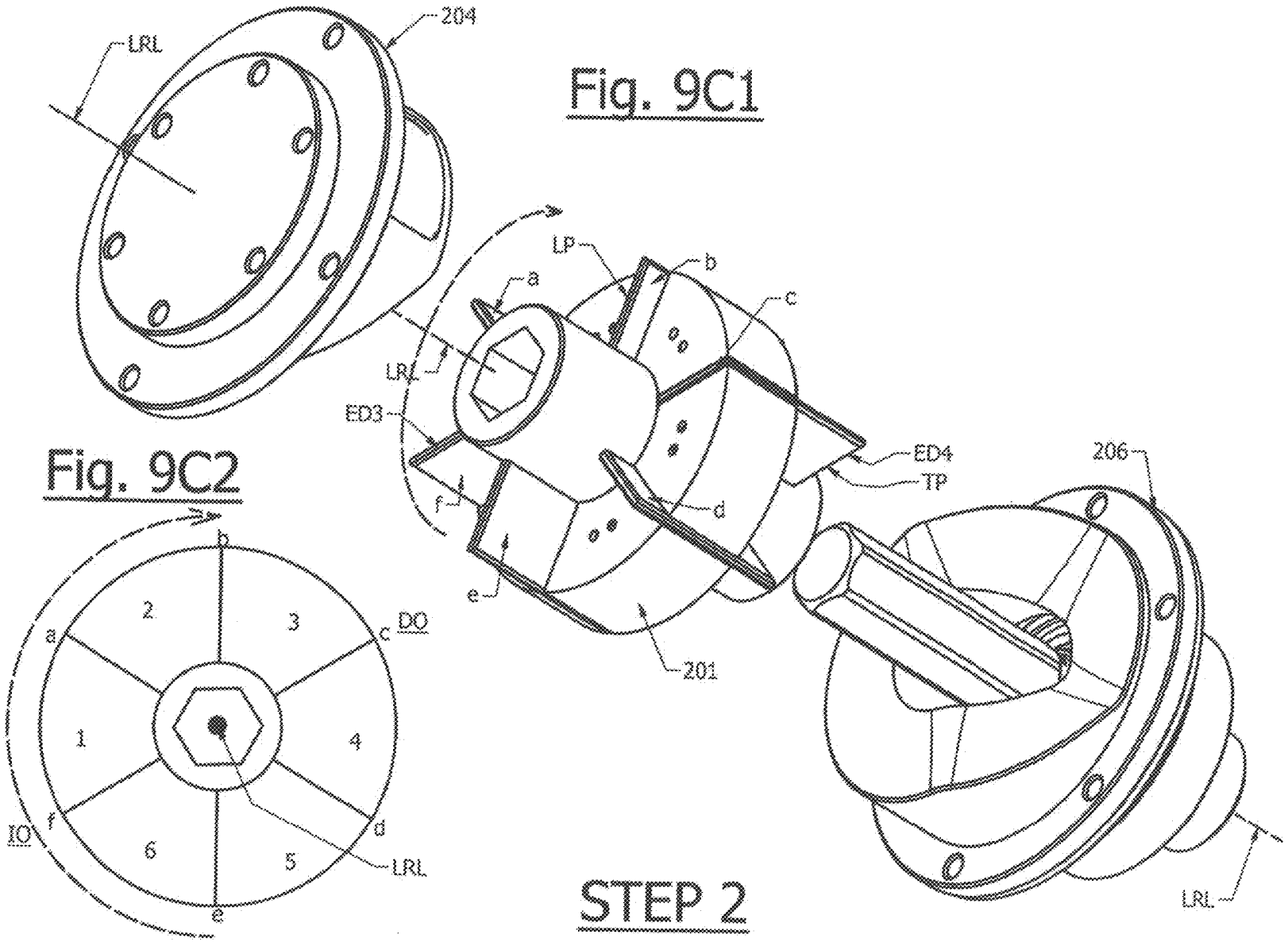
Fig. 9C1
Fig. 9C2

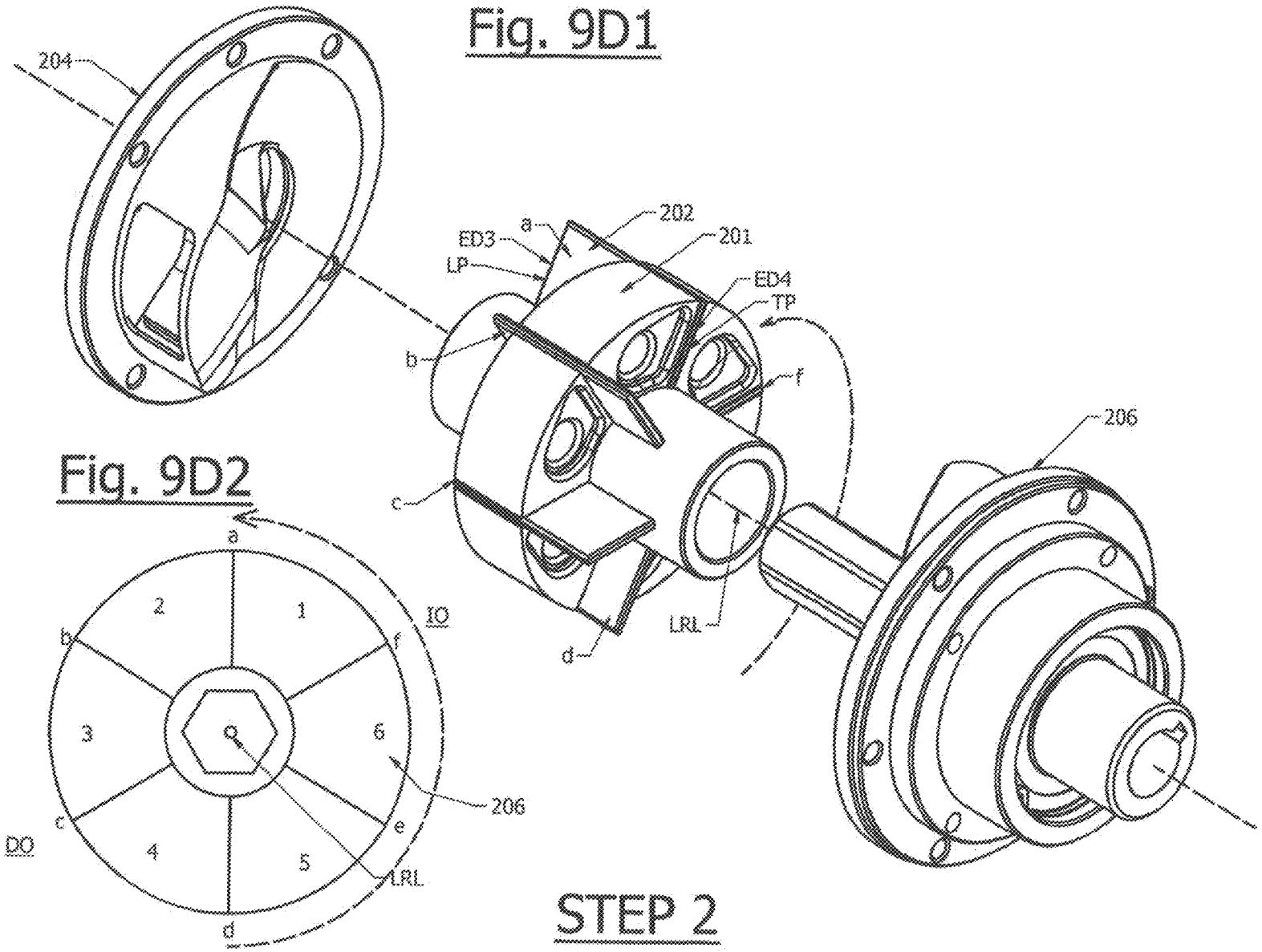
Fig. 9D1
Fig. 9D2
STEP 2

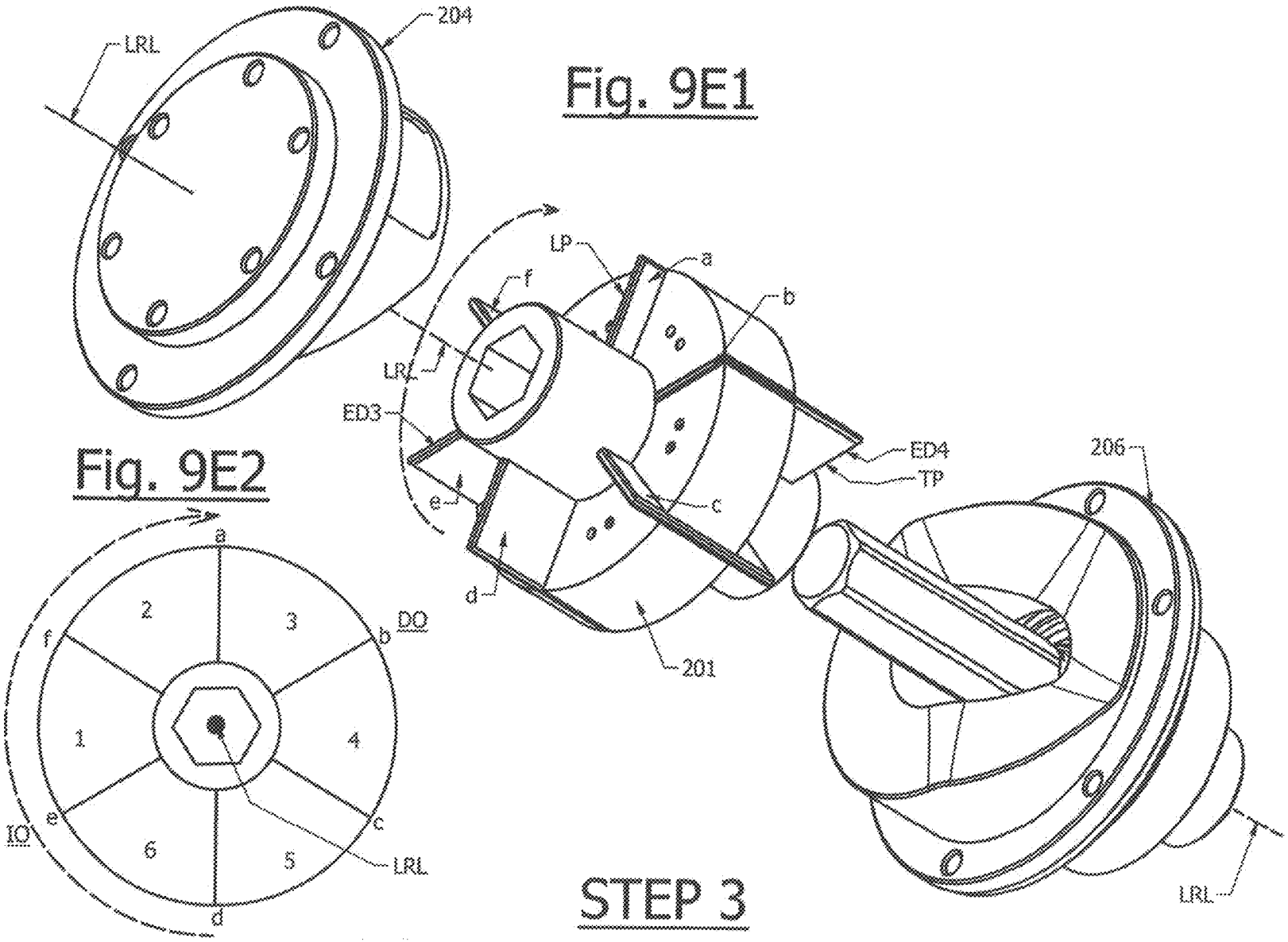
Fig. 9E1
STEP 3
Fig. 9E2
204
LRL
ED3
LRL
f
LP
a
b
ED4
TP
c
e
d
201
206
LRL
DO
IO
1
2
3
4
5
6

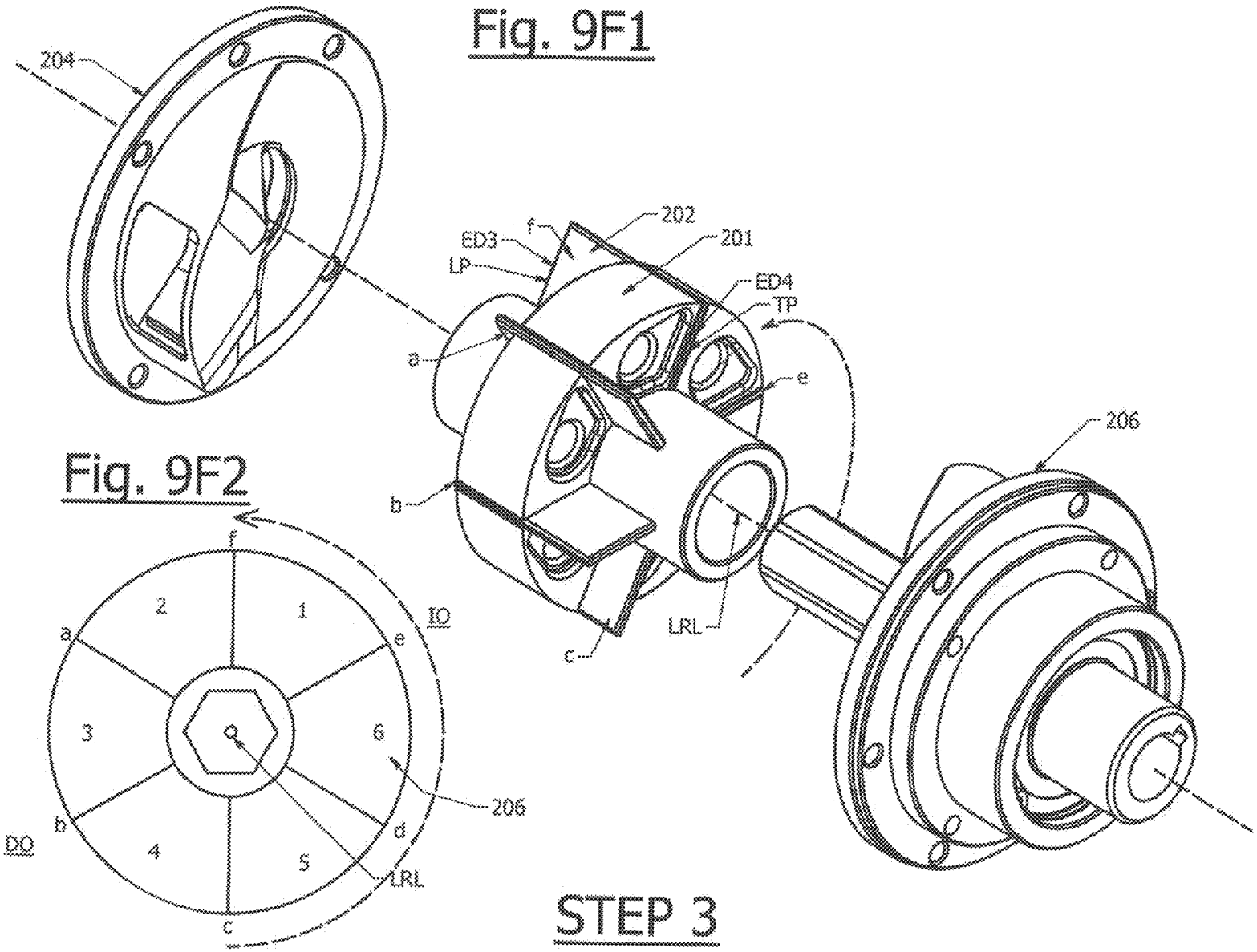
Fig. 9F1
204
206
202
201
ED4
TP
ED3
LP
LRL
a
b
c
d
e
f
Fig. 9F2
DO
IO
1
2
3
4
5
6
STEP 3

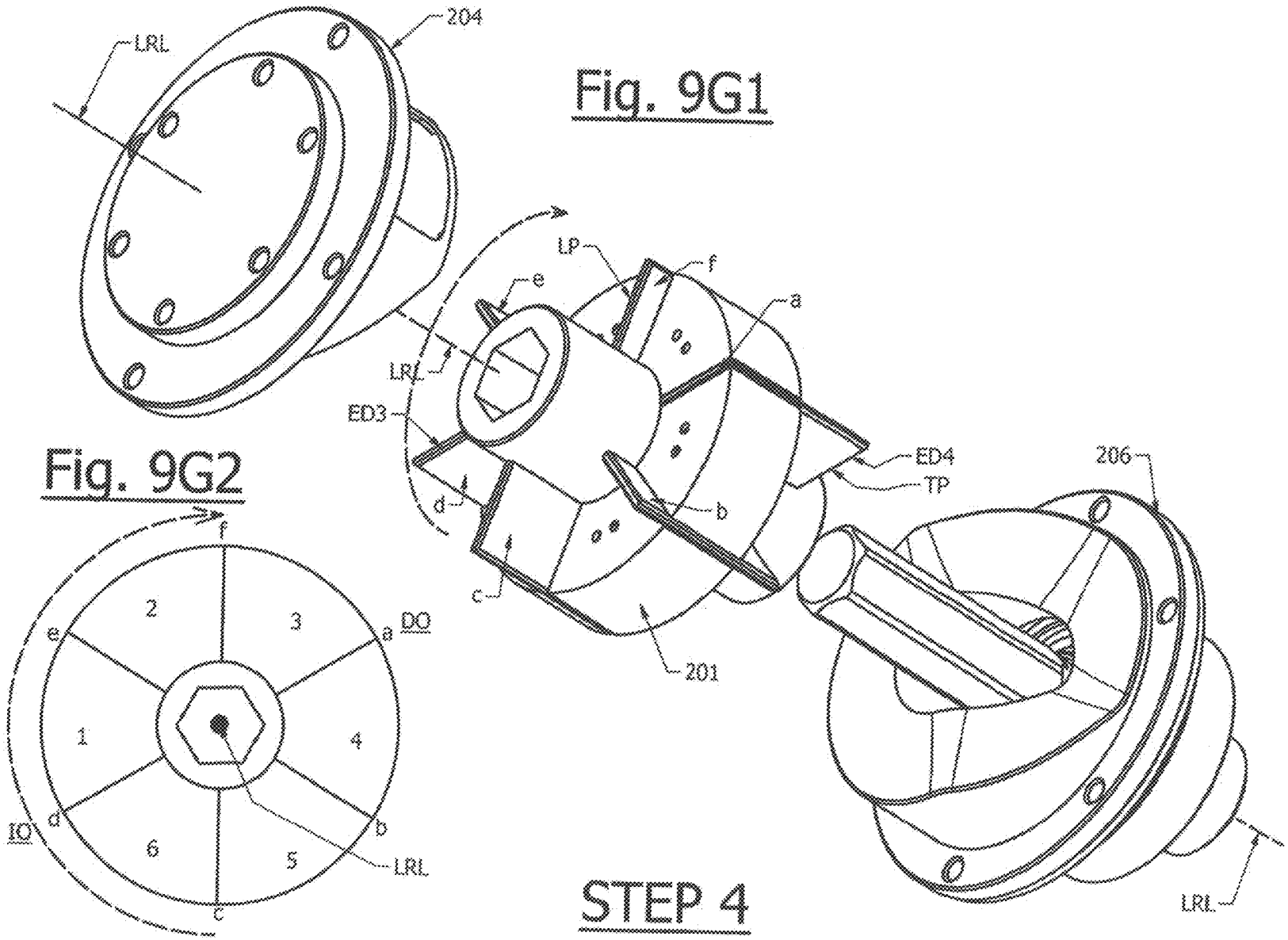
Fig. 9G1
Fig. 9G2
STEP 4

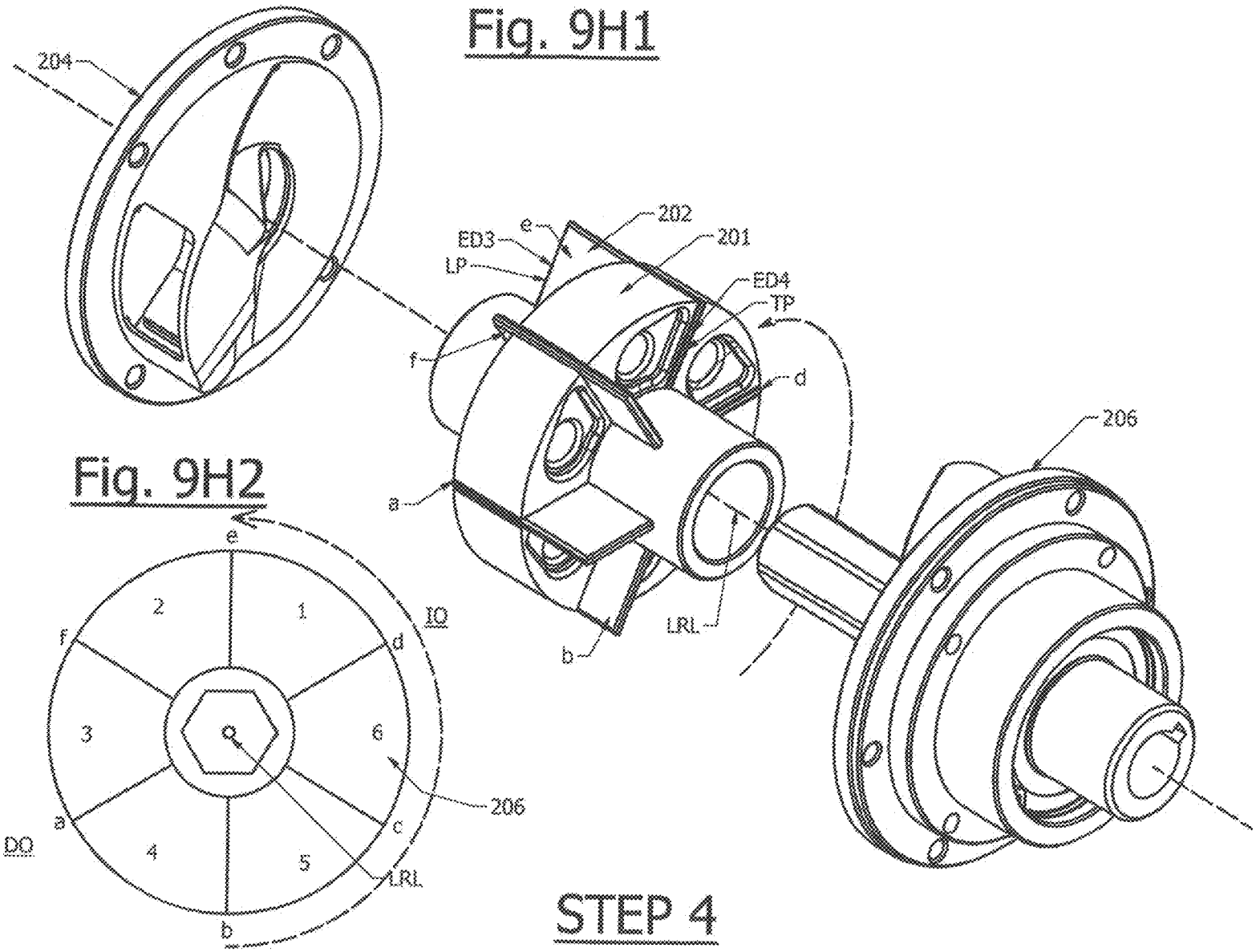
Fig. 9H1
Fig. 9H2
STEP 4

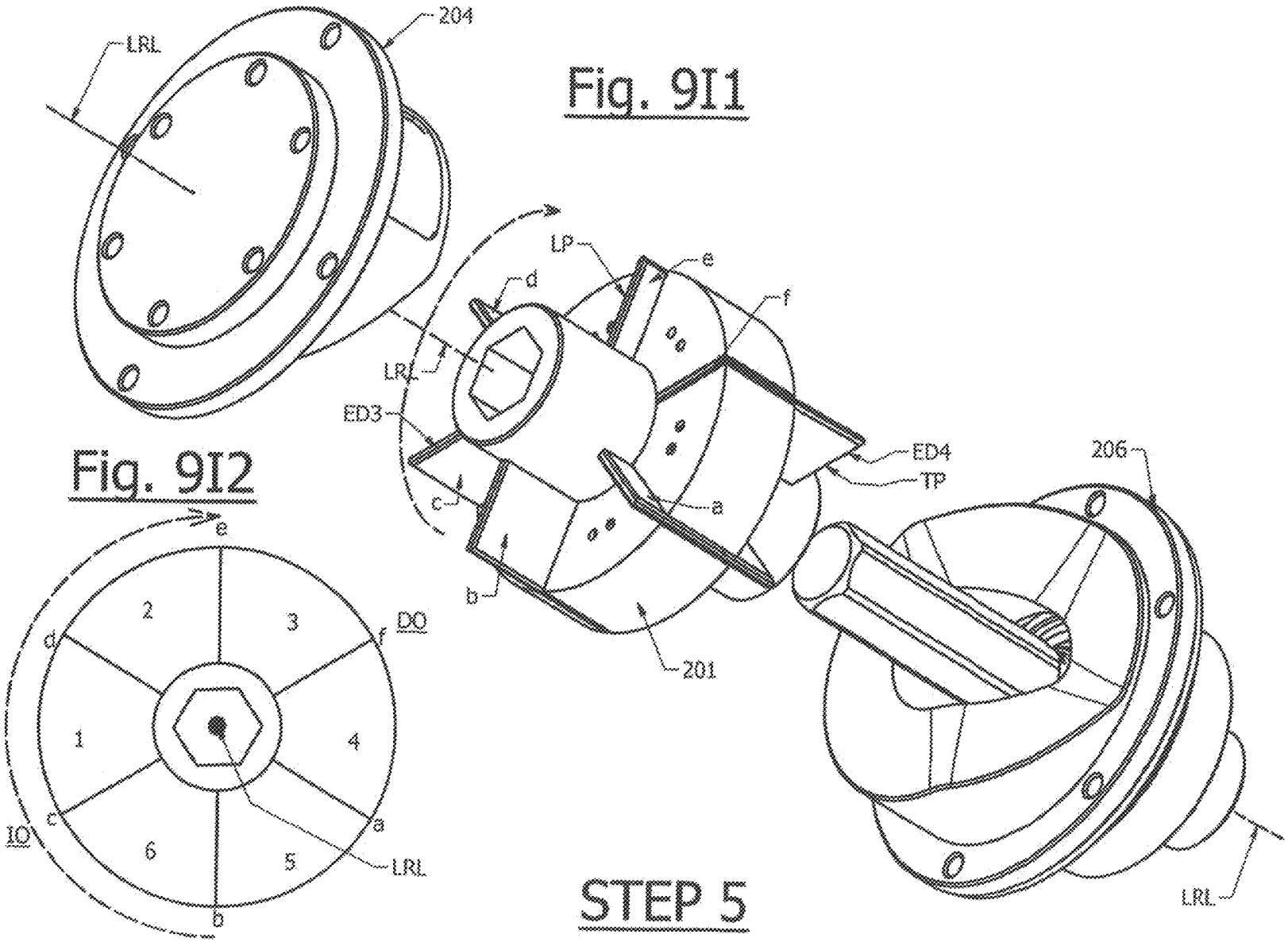
Fig. 9I1
Fig. 9I2
STEP 5

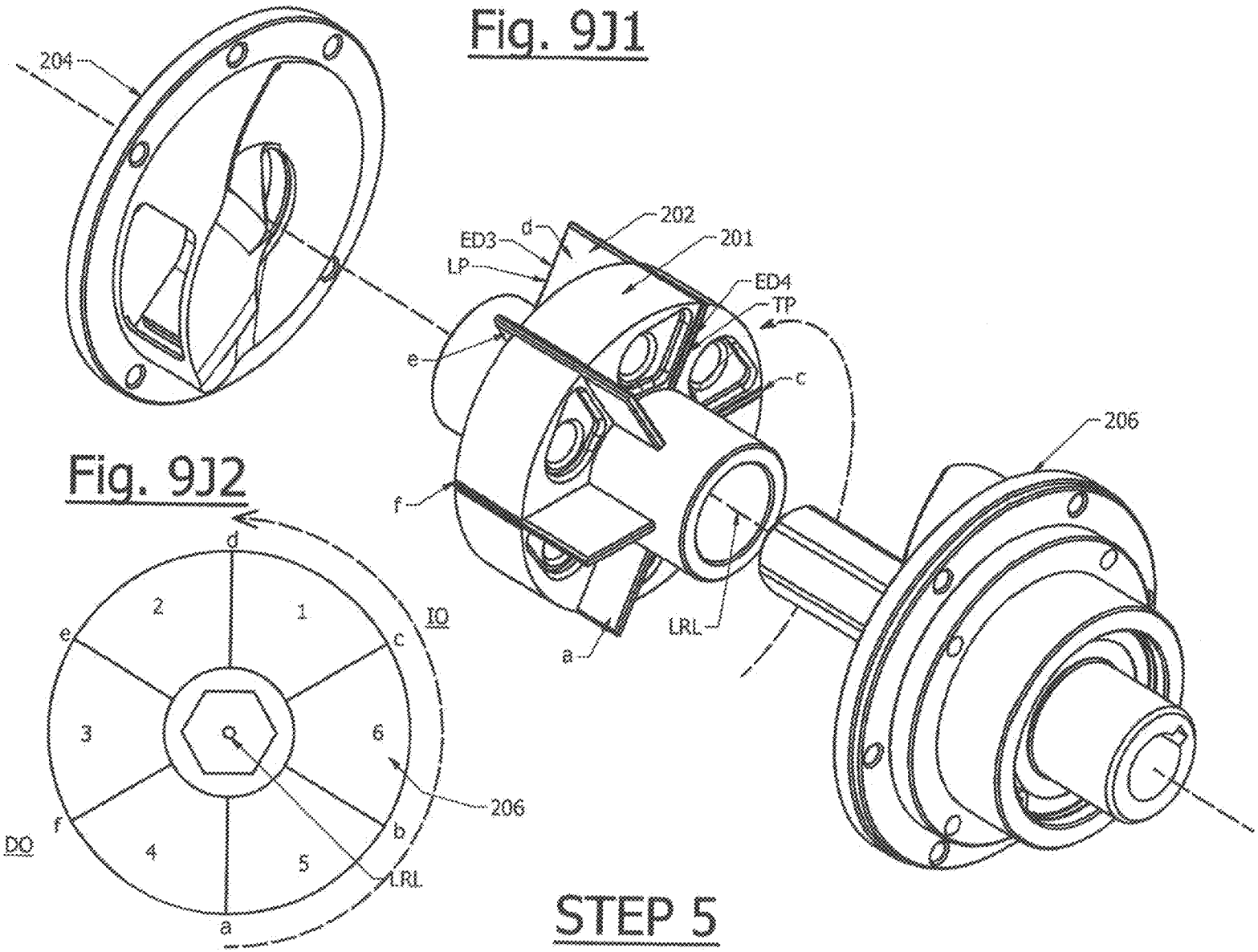
Fig. 9J1
Fig. 9J2
STEP 5

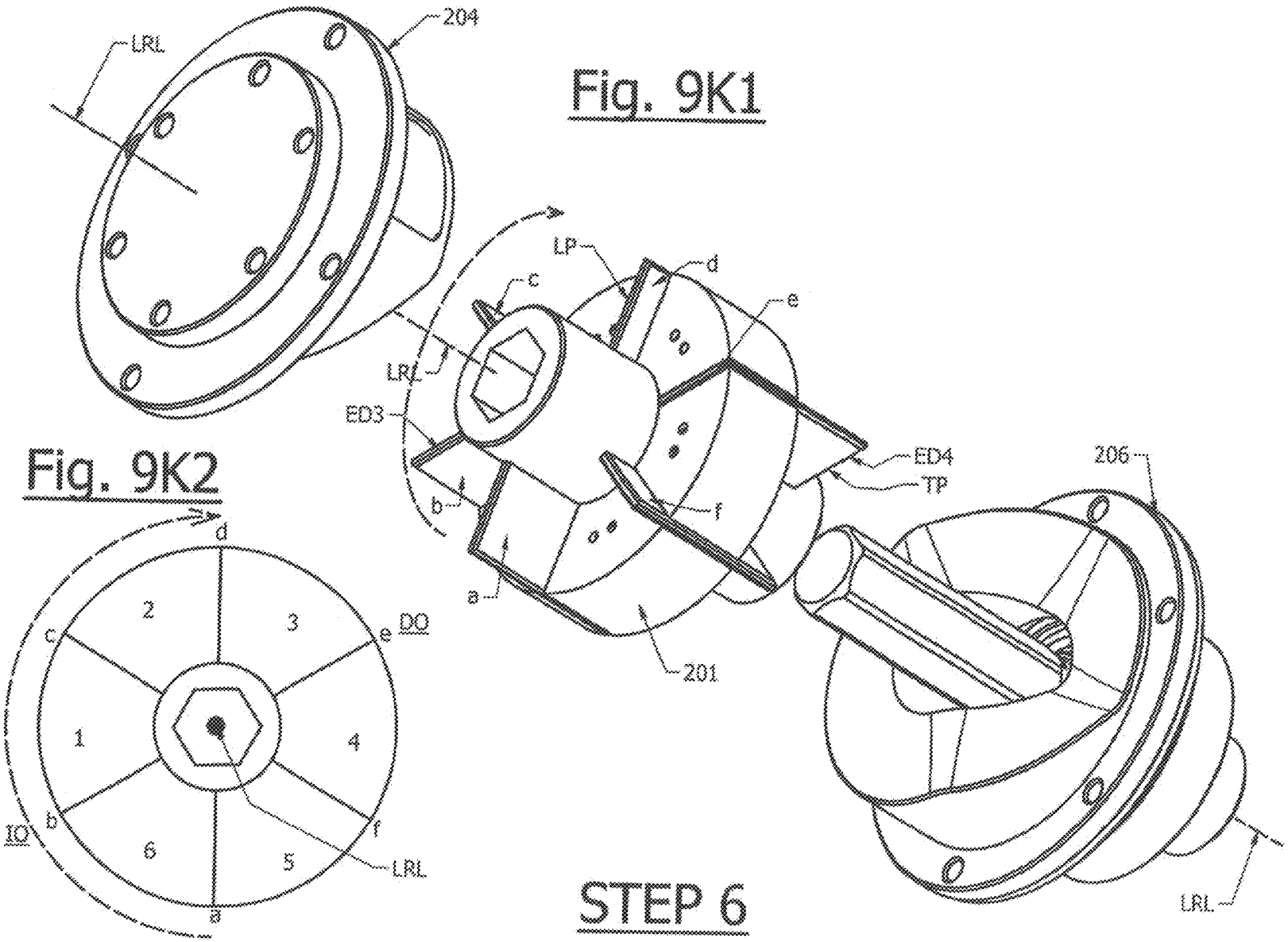
Fig. 9K1
Fig. 9K2
STEP 6

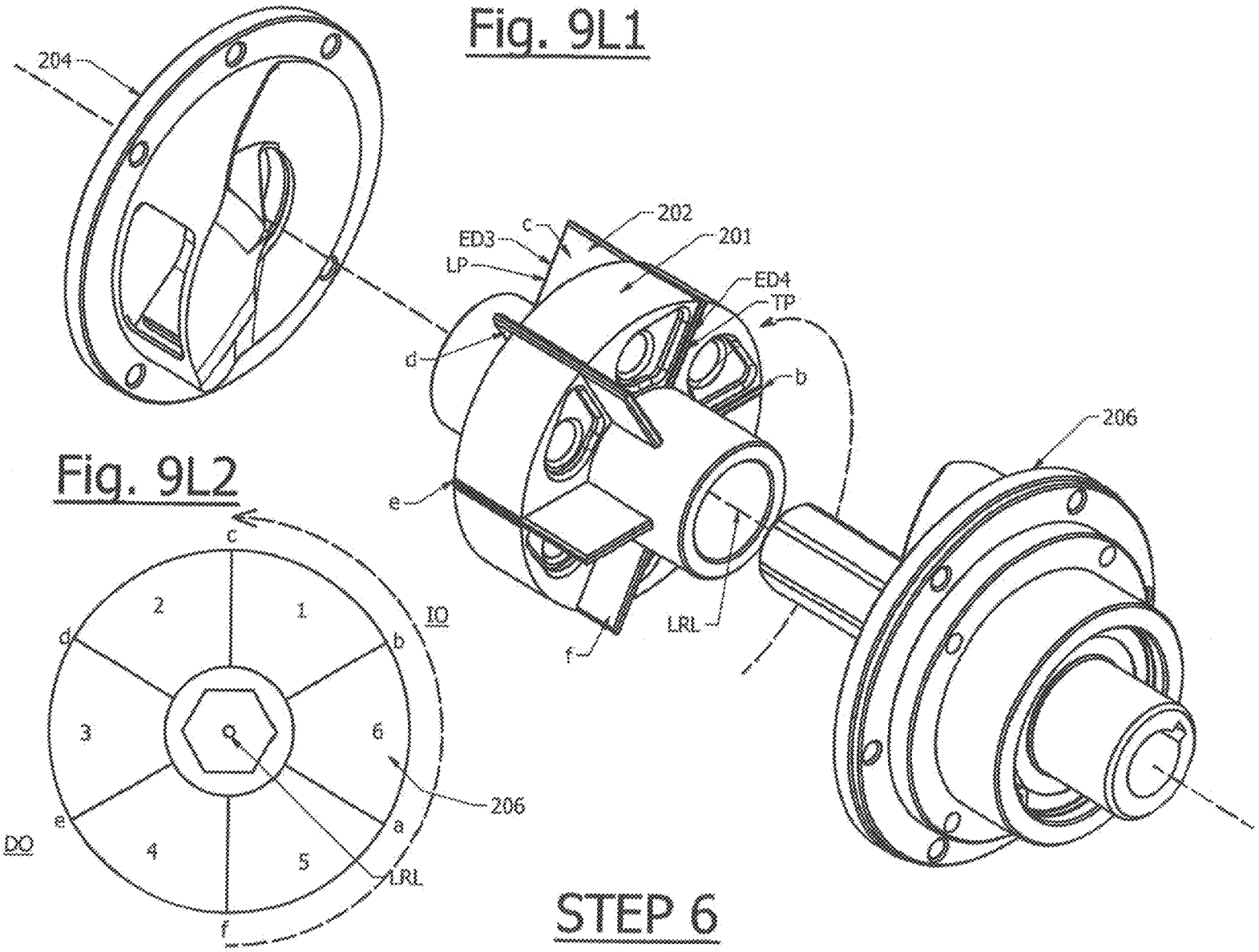
Fig. 9L1
Fig. 9L2
STEP 6

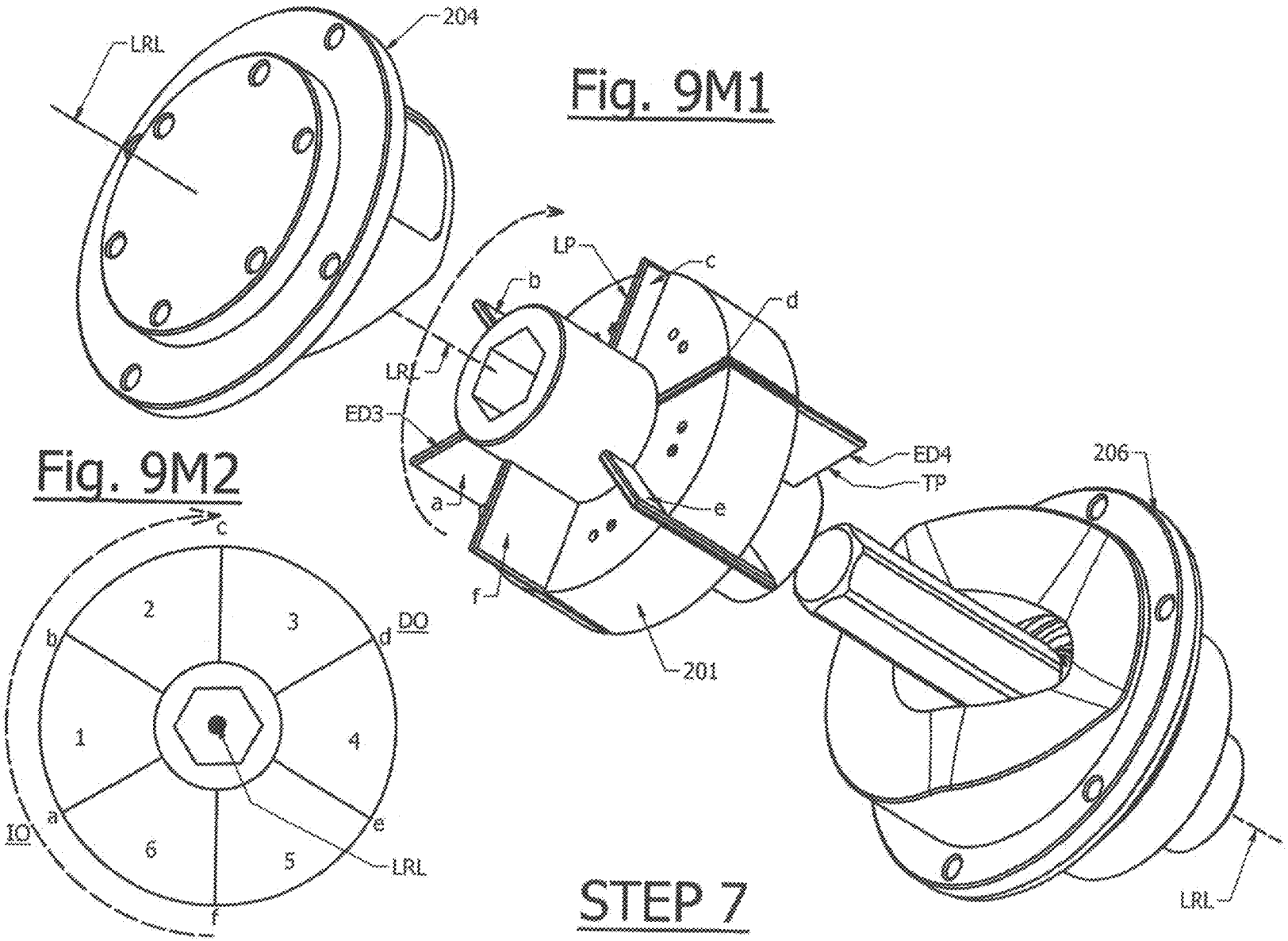
Fig. 9M1
Fig. 9M2
STEP 7

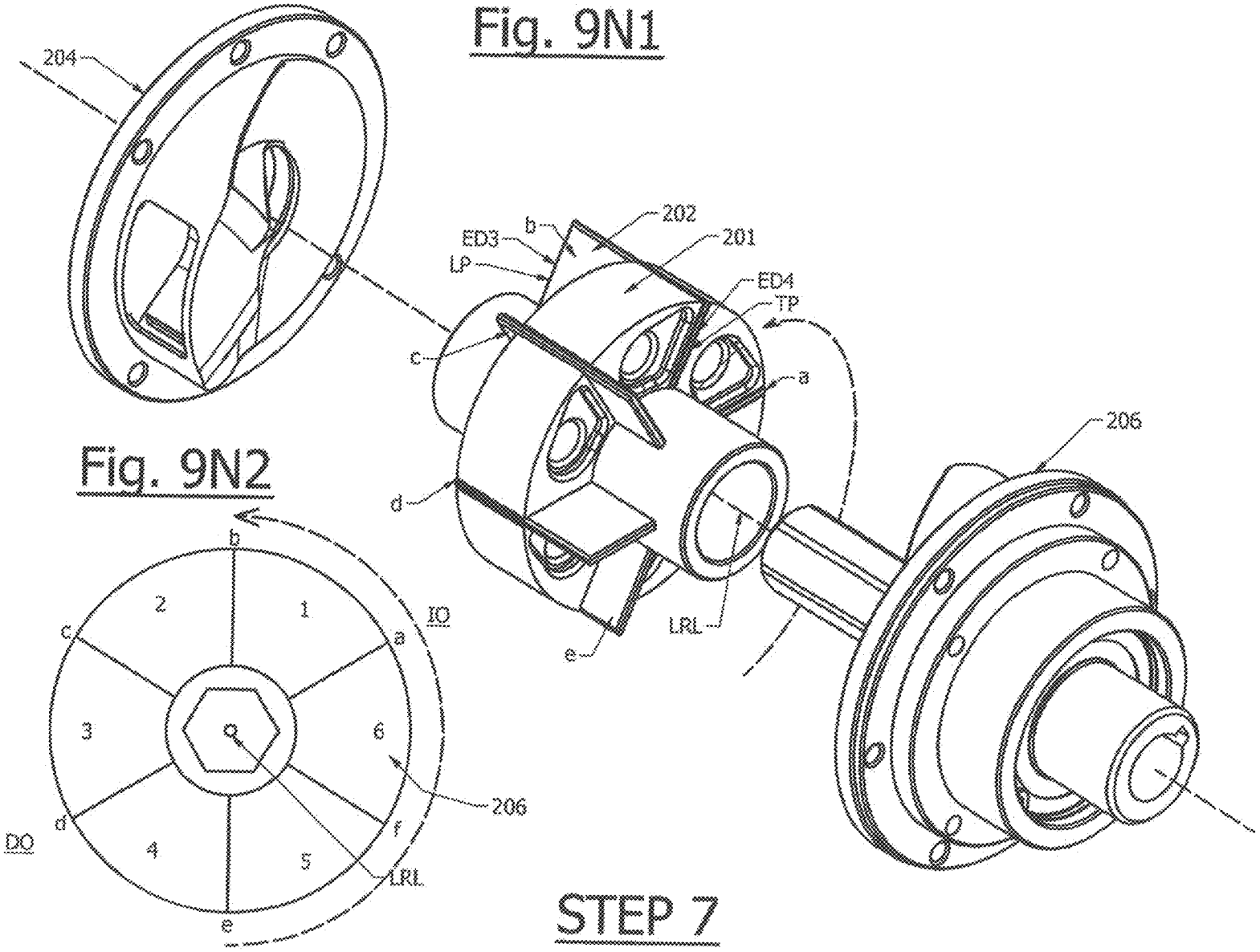
Fig. 9N1
STEP 7
Fig. 9N2
204
205
206
201
202
ED3
ED4
TP
LP
LRL
IO
DO
a
b
c
d
e
f
1
2
3
4
5
6

PUMP HAVING ROTOR MEMBER WITH AXIALLY SLIDING VANES AND A ONE-WAY CHECK VALVE

INCORPORATION BY REFERENCE

Any and all U. S. patents, U. S. patent applications, and other documents, hard copy or electronic, cited or referred to in this application are incorporated herein by reference and made a part of this application.

Definitions

The words "comprising," "having," "containing," "holding," and "including," and other grammatical forms thereof, are intended to be equivalent in meaning and be open ended in that an item or items following any one of these words is not meant to be an exhaustive listing of such item or items, nor meant to be limited to only the listed item or items.

The word "rectangular" includes square.

BACKGROUND

Displacement pumps are well known equipment for moving fluids. U. S. Patent Application No. 2012/0171337 A1 discloses a portioner apparatus for dividing baker's dough into pieces. The disclosed portioner apparatus employs a displacement pump for moving this highly viscous material through the apparatus. The baker's dough is fluid but viscous and difficult to pump. My pump may be used to pump any fluid material, for example, such high viscous material as baker's dough or runny, liquid material such as water.

SUMMARY

My pump has one or more of the features depicted in the embodiments discussed in the section entitled "DETAILED DESCRIPTION OF SOME ILLUSTRATIVE EMBODIMENTS." The claims that follow define my pump, distinguishing it from the prior art; however, without limiting the scope of our as expressed by these claims, in general terms, some, but not necessarily all, of their features are:

One, my pump has a longitudinal reference line extending along a drive shaft that is at least partially enclosed within a housing with opposed open ends. The housing has an internal wall between the open ends, and the internal wall has nearby one end first and second housing ports that are spaced apart and aligned opposite each other.

Two, a passageway plate is mounted at the one end, and it includes an inward facing passageway cam surface. A drive plate is mounted at the other open end, and it includes an inward facing drive cam surface. A rotor member is within the housing between the passageway and drive plates and is connected to and driven by the drive shaft to rotate as the drive shaft rotates.

Three, the housing, plates, and rotor member in assembly form a passageway between the passageway cam surface and a first side of the rotor member. The passageway places an intake opening and a discharge opening in communication with each other along the passageway.

Four, a vane element is attached to the rotor member and includes opposed vane edges, one edge engaging the passageway cam surface and the other edge engaging the drive cam surface. The vane element slides laterally and moves reciprocally as the rotor member rotates. The opposed vane edges respectively engage the passageway cam surface and drive cam surface, moving the fluid material being fed into the intake opening, through the passageway, and finally out the discharge opening.

Five, the rotor member may comprise a plurality of radial arms at a right angle to the drive shaft and positioned next to each other with a narrow gap between adjacent arms. A plurality of individual vane elements are individually seated snugly in individual gaps to move laterally within the gap as the rotor member rotates. The rotor member has a first side facing the passageway cam surface and an opposed second side facing the drive cam surface. The vane elements are rectangular shaped, the radial arms are wedged shaped, the rotor member is circular shaped, and the plates are circular shaped.

Six, in one embodiment, the vane elements divide the passageway into a series of adjacent pie shaped chambers that vary in volume as the rotor member revolves. A vacuum is created as individual vane elements pass the intake opening to expand one chamber nearby the intake opening from 0-volume to maximum volume, sucking the fluid material at the intake opening into the expanding chamber. The passageway cam surface and drive cam surface each have predetermined topographies that face each other and are interactive to control the lateral, reciprocal movement of a vane element as the rotor member rotates. The predetermined topographies are configured to establish a mutual matching-mating type relationship between them so the vane elements move in a controlled sequence as the rotor member revolves through one complete rotational cycle.

Seven, a one-way check valve in at least one of the radial arms opens in response to a predetermined elevated pressure of fluid material captured in an accumulation cavity in the second side of the rotor member, recycling fluid material to the passageway from the accumulation cavity.

These features are not listed in any rank order nor is this list intended to be exhaustive.

DESCRIPTION OF THE DRAWING

Some embodiments of my pump are discussed in detail in connection with the accompanying drawing, which is for illustrative purposes only. This drawing includes the following figures (FIGS.), with like numerals and letters indicating like parts:

FIG. 7A is a left hand perspective view of my pump shown in FIG. 1 with the housing detached and the rotor member positioned to cover the intake opening of the passageway with a vane element.

FIG. 7B is a right hand perspective view of my pump shown in FIG. 7A with the housing detached and the rotor member repositioned and the vane element moved away from the intake opening of the passageway.

FIG. 7C is a side view similar to that shown in FIG. 7A looking into a discharge opening of my pump.

FIG. 9A1 is a perspective view of a detached passageway plate and rotor member mounted on the drive shaft and the rotor member's vane elements positioned to engage the passageway plate's cam surface upon attachment of this passageway plate to the housing.

FIG. 9A2 is a diagram illustrating the position of the rotor member's vane elements with respect to the passageway plate cam surface as depicted in FIG. 9A1 upon attachment of this plate to the housing and the rotor member's vane elements in the initial position of the rotational cycle of the rotor member.

FIG. 9B1 is a perspective view of a detached drive plate and rotor member mounted on the draft shaft and the rotor member's vane elements positioned to engage the drive plate's cam surface upon attachment of this passageway plate to the housing.

FIG. 9B2 is a diagram illustrating the position of the rotor member's vane elements with respect to the drive plate cam surface as depicted in FIG. 9A1 upon attachment of this drive plate to the housing and the rotor member's vane elements in the initial position of the rotational cycle of the rotor member.

FIGS. 9C1 through 9N2 are in pairs similar to FIGS. 9A1 through 9B2 showing the relative positions of the vane elements with respect to the passageway and drive plates as the rotor member moves through one complete rotational cycle.

DETAILED DESCRIPTION OF SOME ILLUSTRATIVE EMBODIMENTS

Figure 1:
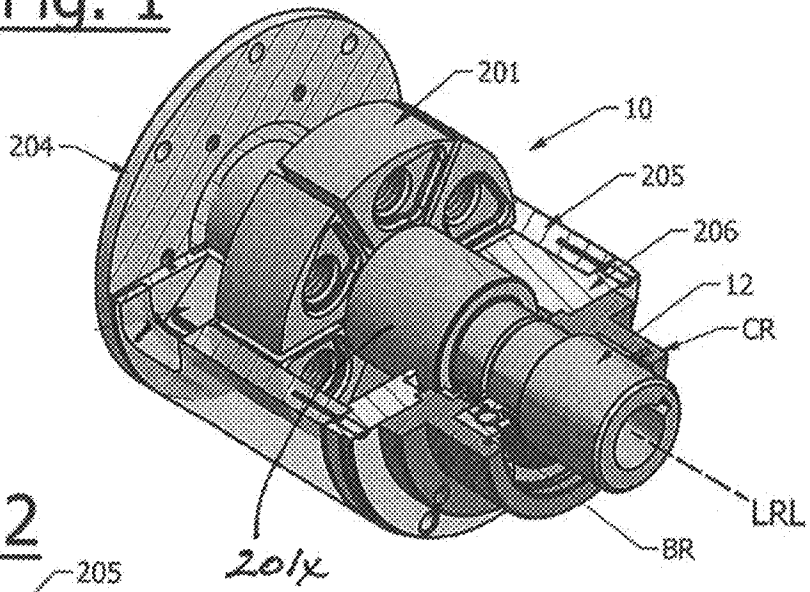
FIG. 1 is a perspective view of one embodiment of my pump with sections broken away.
Figure 3:
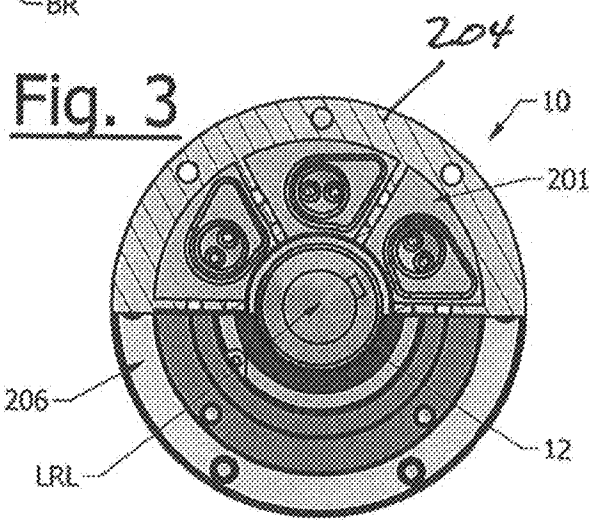
FIG. 3 is a cross-sectional view taken along line 3-3 of FIG. 2.
Figure 2:
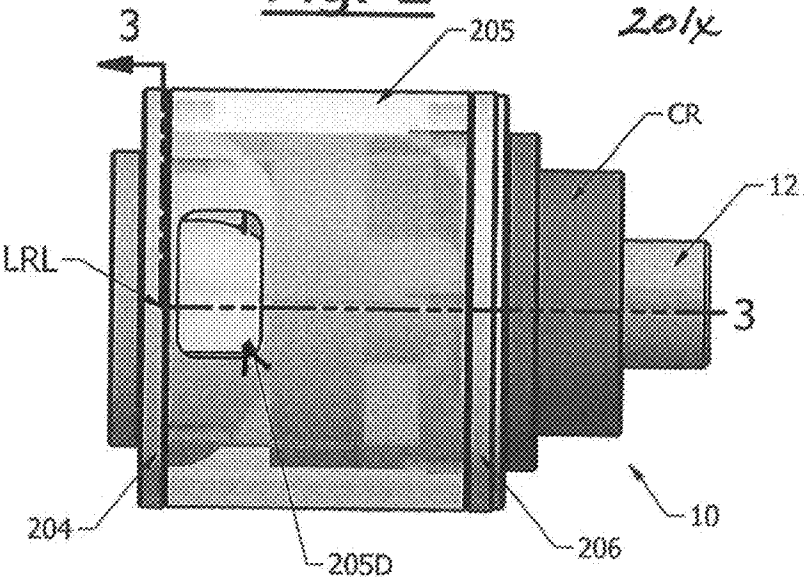
FIG. 2 is a side view of the embodiment of my pump shown in FIG. 1.

As best shown in FIGS. 1 through 8, one embodiment of my pump is generally designated by the numeral 10. Although it may be used for several types of fluids, it is very useful for pumping highly viscous material. My pump 10 has a longitudinal reference line LRL extending through the pump's drive shaft 12 and it includes a housing 205, a passageway plate 204, a drive plate 206, and a rotor member 201. Opposed ends 12*a* and 12*b* (FIG. 1A) of the drive shaft 12 project outward from opposed terminal open ends E1 and E2 (FIG. 1A) of the housing 205. The passageway plate 204 and the drive plate 206 are circular shaped and have the same diameter, and the housing 205 is cylindrically shaped and generally of the same diameter as the plates 204 and 206. As discussed in greater detail subsequently, a passageway P is formed between the passageway plate 204 and the rotor member 201 that has an intake opening IO at one end of the passageway P and a discharge opening DO at an opposite end of the passageway.

Figure 1A:
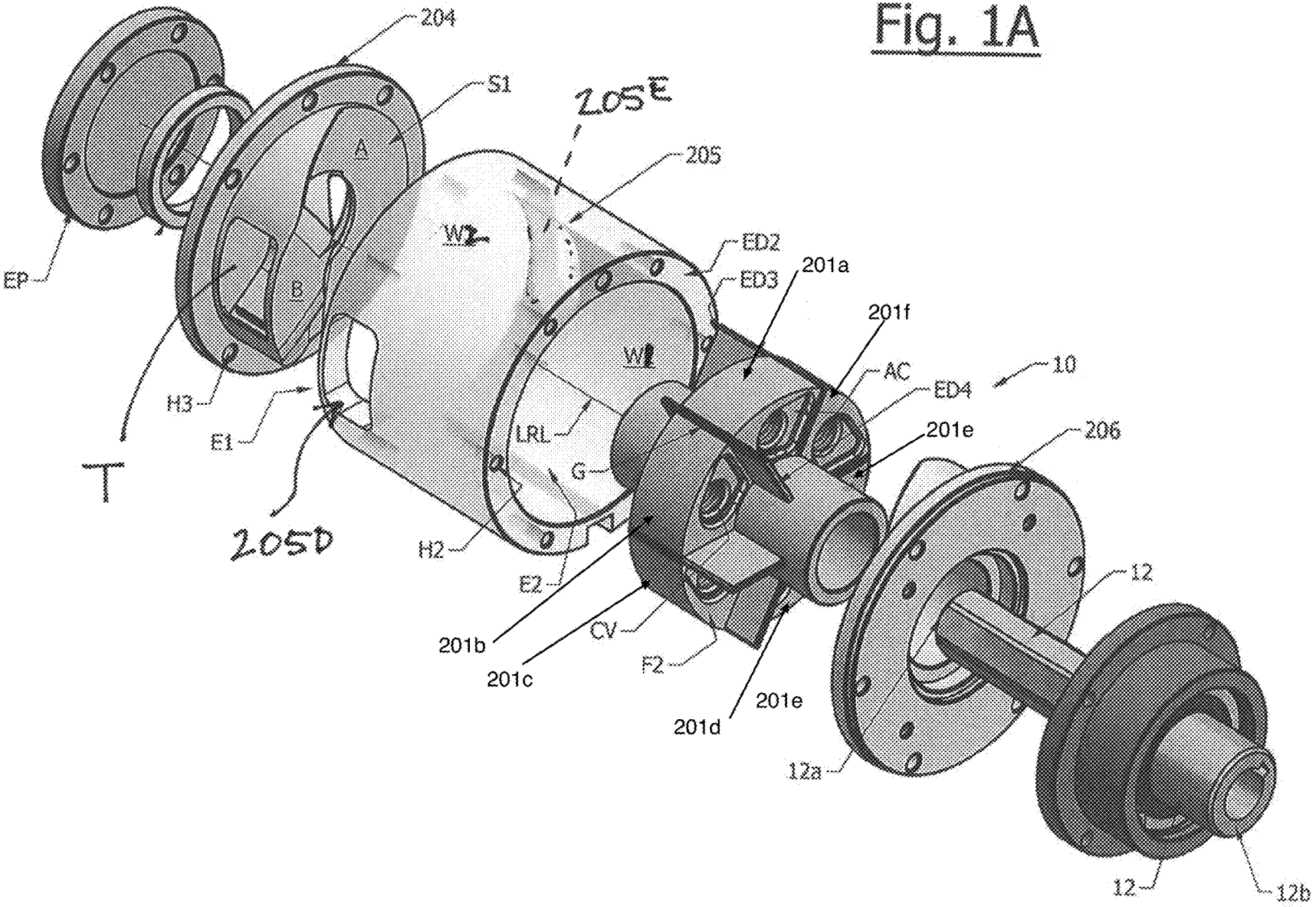
FIG. 1A is an exploded perspective view of one embodiment of my pump.
Figure 10A:
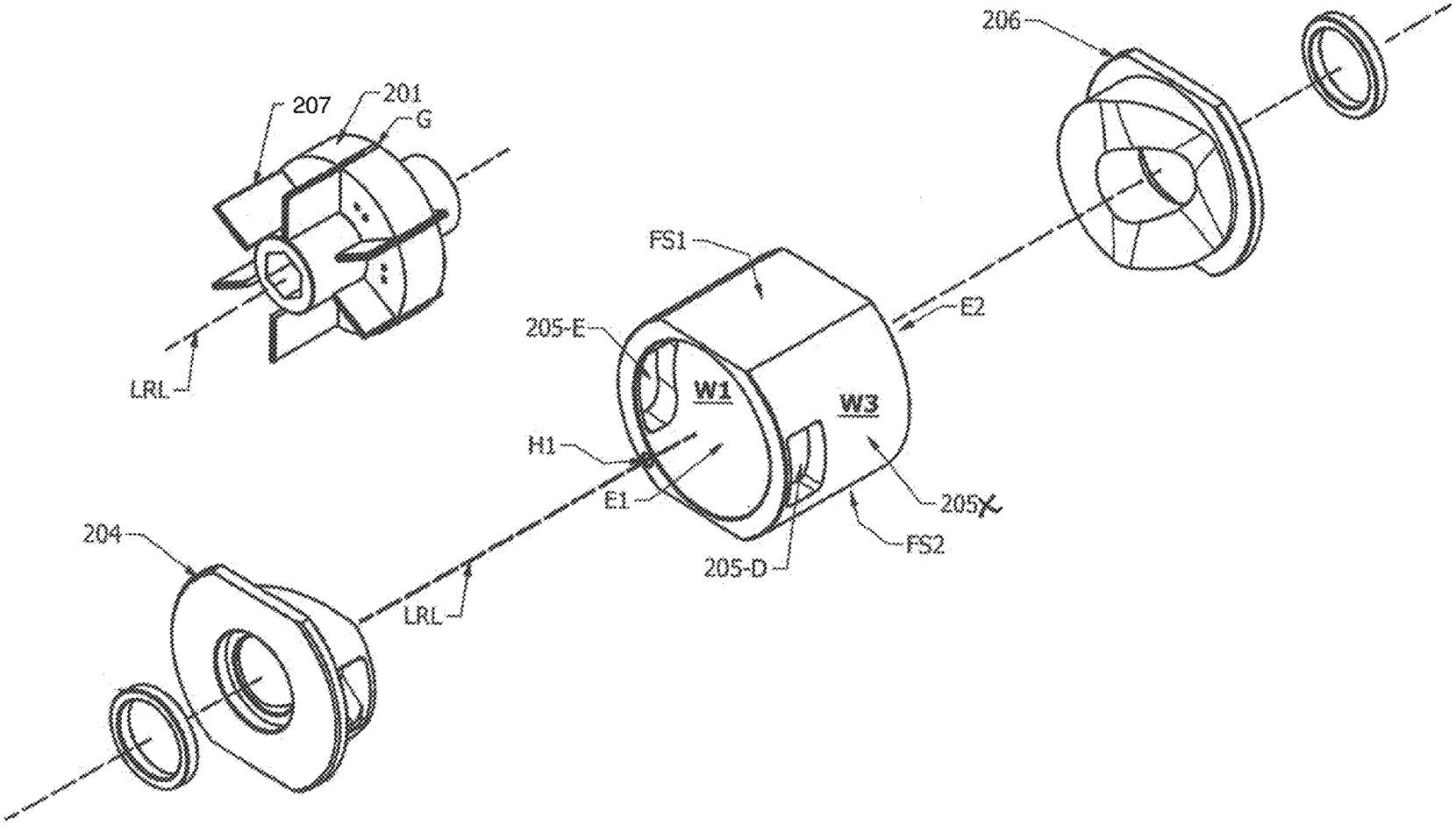
FIG. 10A is an exploded right hand perspective view similar to FIG. 4A illustrating an alternate shaped housing for use with a portioner apparatus.
Figure 10B:
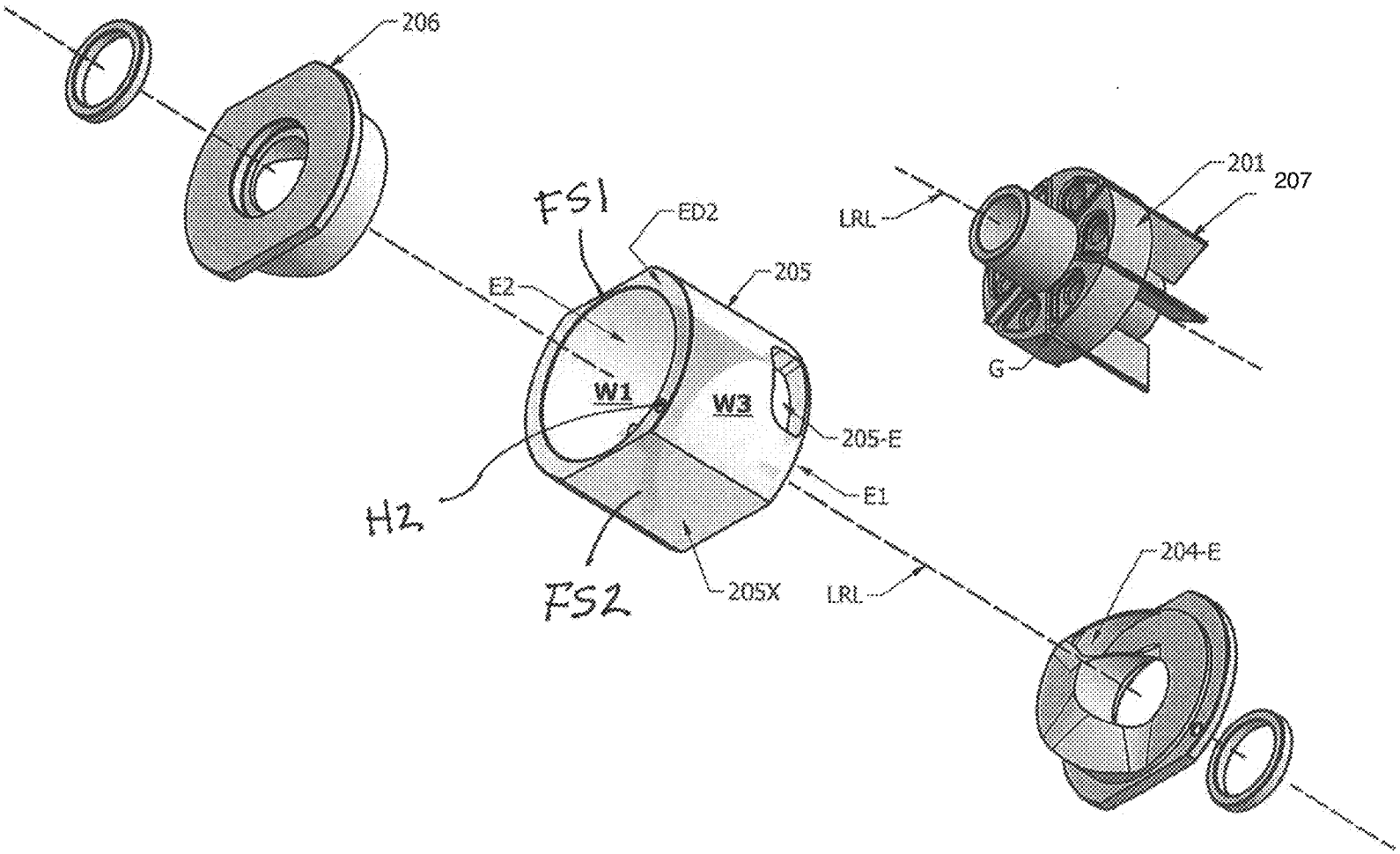
FIG. 10B is an exploded left hand perspective view similar to FIG. 4B illustrating the alternate shaped housing depicted in FIG. 4A.

The housing embodiment depicted in FIGS. 1-8C is designated by the numeral 205 and has smooth internal and external, cylindrically shaped walls W1 and W2, respectively (FIG. 1A). The housing embodiment depicted in FIGS. 10A and 10B is designated by the numeral 205*x*. Both housings 205 and 205*x* have opposed terminal open ends E1 and E2 defined by a flat-surface, and opposed circular edges, respectively ED1 (FIG. 7A) and ED2 (FIG. 7B). Nearby the terminal open end E1 is a pair of housing ports 205-D and 205-E that are spaced apart and aligned opposite each other as best shown in FIGS. 4A and 10A. As shown in FIG. 10A, the housing 205*x* has a smooth internal cylindrically shaped wall W1. In its external wall W3 is a pair of opposed flat, rectangular segments FS1 and FS2 centered between the housing ports 205-D and 205-E. Drilled into the edges ED1 and ED2 of the housings 205 and 205*x* are a series of bolt-holes H1 and H2, respectively.

Figure 6B:
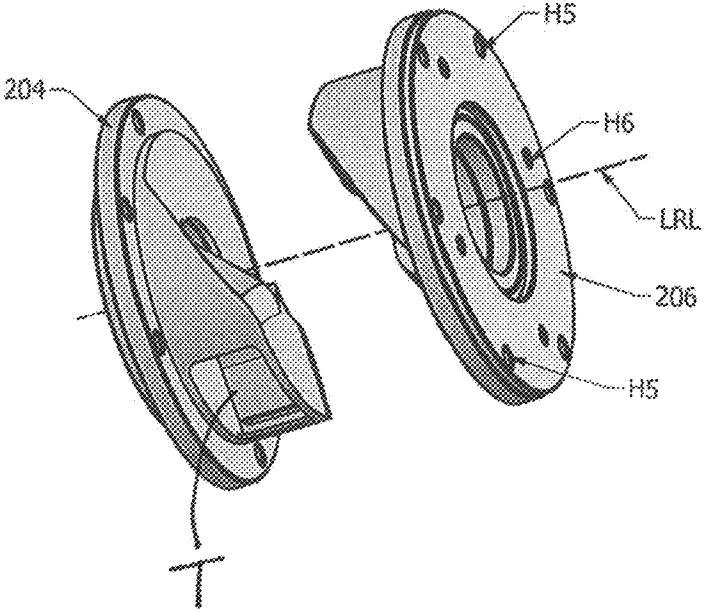
FIG. 6B is a left hand perspective view similar to that shown in FIG. 6A but with the aligned detached end plates rotated to show the outlet in the rim section of the passageway plate.
Figure 6A:
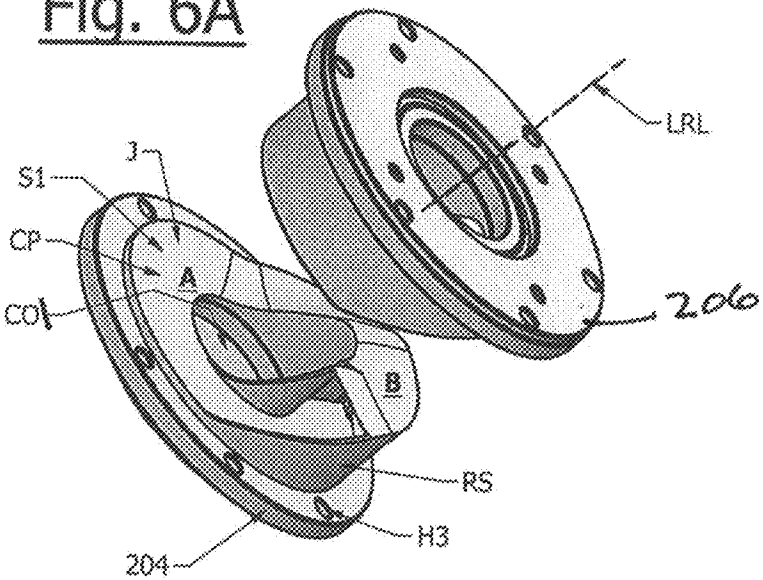
FIG. 6A is a perspective view of detached end plates aligned with inner cam surfaces facing each other and the topography of the passageway cam surface exposed.
Figures 8A, 8B, 8C:
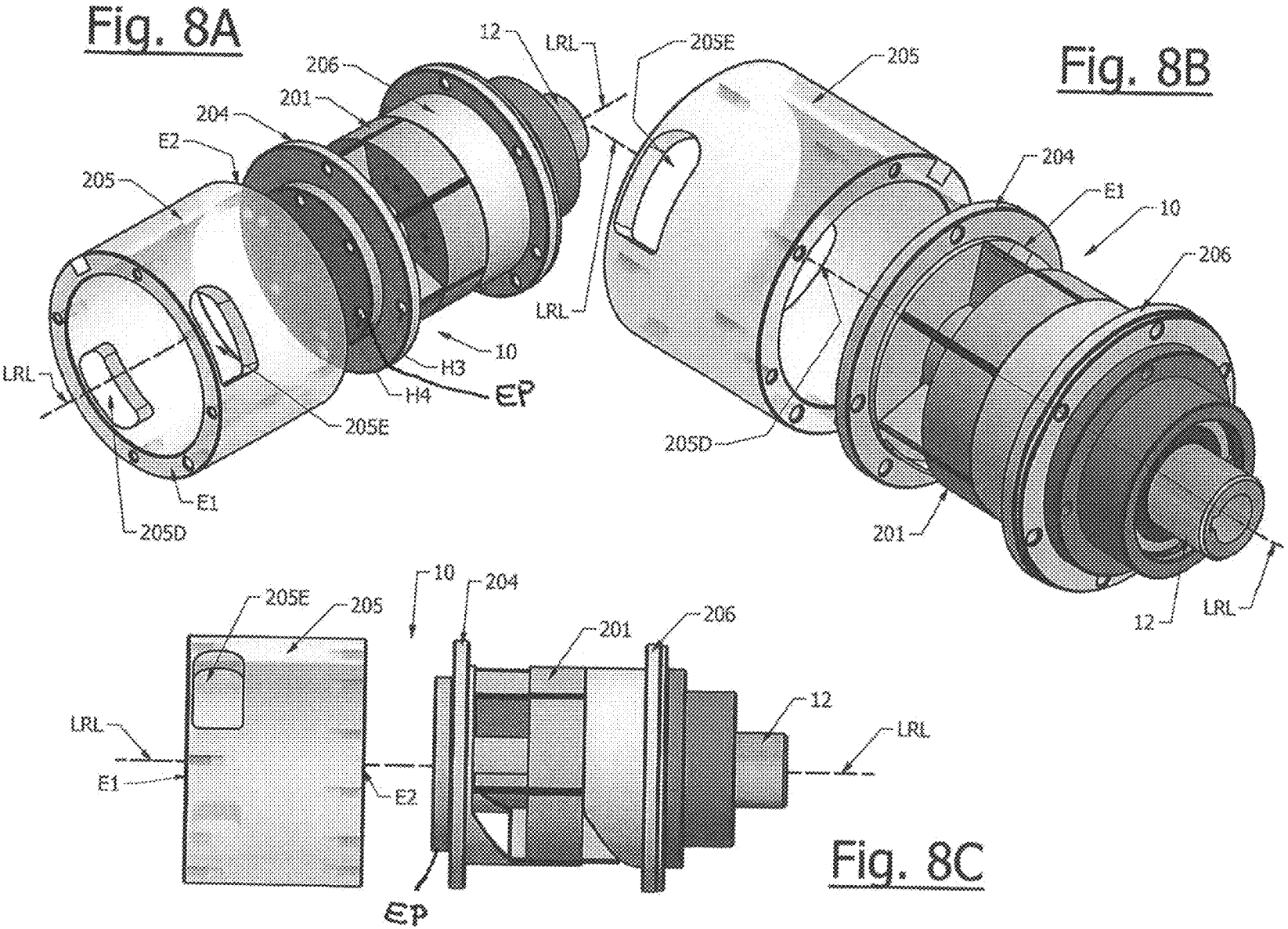
FIG. 8A is a left hand perspective view of my pump shown in FIG. 7A with the rotor member repositioned to expand the volume of a material holding chamber.
FIG. 8B is a right hand perspective view of my pump shown in FIG. 7A.
FIG. 8C is a side view similar to that shown in FIG. 7A looking into a discharge opening of my pump.

The passageway plate 204 is mounted at the terminal open end E1 of the housing 205. As best shown in FIG. 6A, the passageway plate 204 includes a central opening CO, a circular rim section RS, and a series bolt-holes H3 along the rim section's perimeter encircling inward facing passageway cam surface S1. As shown in FIG. 8A, a series of inner bolt-holes H4 surround and are adjacent the central opening CO1. These bolt-holes H4 are inward of the bolt-holes H1 and enable an end plate EP to be bolted to the passageway plate 204.

Figure 4A:
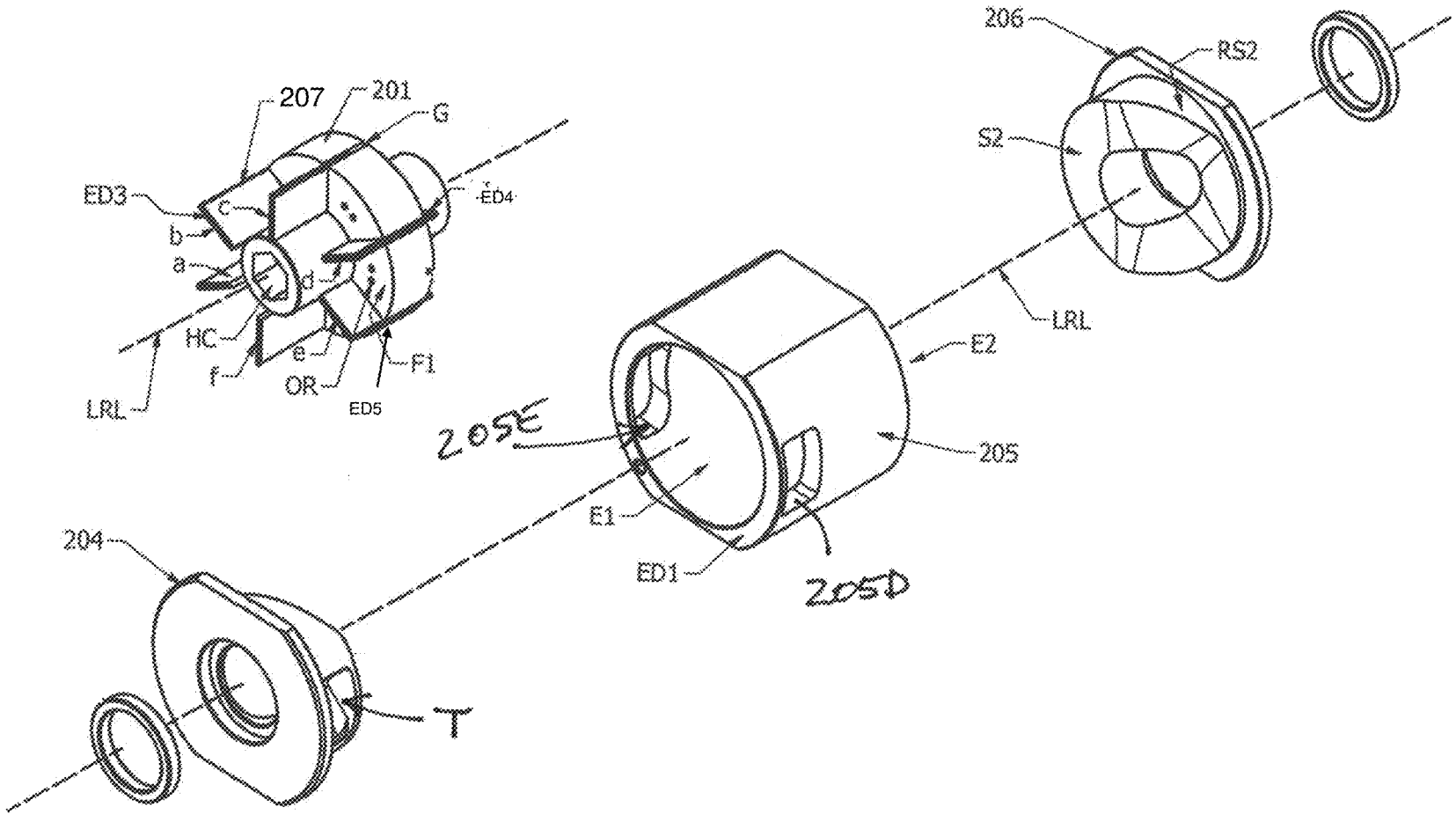
FIG. 4A is an exploded right hand perspective view of the embodiment of my pump shown in FIG. 2.
Figure 6C:
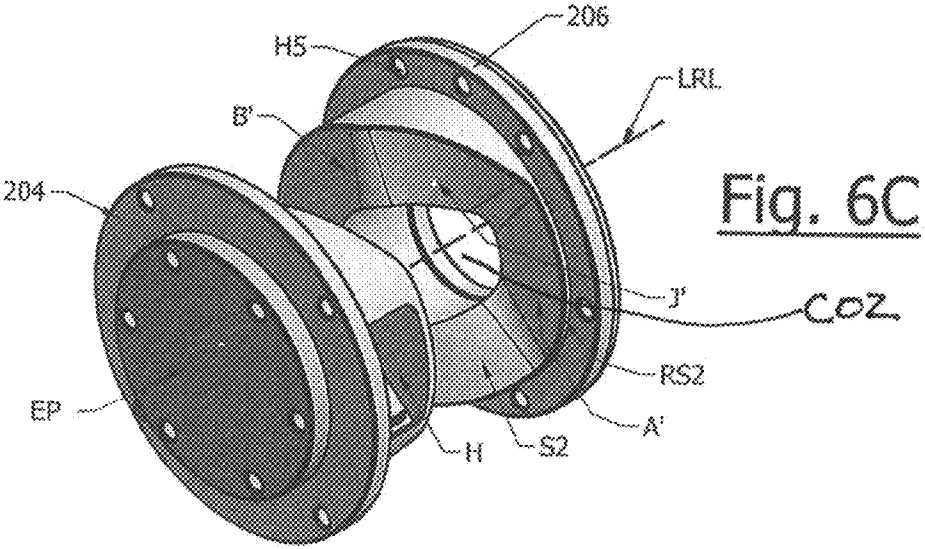
FIG. 6C is a right hand perspective view similar to that shown in FIG. 6A but with the aligned detached end plates rotated to show the outlet in the rim section of the drive plate and the topography of the drive cam surface.

As best illustrated in FIG. 6A, the passageway cam surface S1 has a raised circular platform CP that provides a raised surface section B that slopes upward from a lower, generally flat surface section A merging along a junction J along the lowest edge portion of the raised surface section B. As best shown in FIG. 4A, the drive cam surface S2 of the drive plate 206 is a mirror image of the passageway cam surface S1 as best illustrated in FIGS. 6A through 6C. The passageway cam surface S1 and drive cam surface S2 have complimentary topographies that match and are interactive to control the movement of a plurality vane elements 207 individually identified by the letters a through f of the rotating rotor member 201. The vane elements 207 move both lateral and reciprocal simultaneously as the rotor member 201 rotates.

As best shown in FIG. 6C, the drive cam surface S2 has a raised surface section B' that slopes upward from a lower, generally flat surface section A' merging along a junction J' along the lowest edge portion of the raised surface section B'. The passageway plate 204 and the drive plate 206 are positioned and oriented with respect to each other, so that the raised surface section B' of the drive plate 206 is opposed to the flat surface section A of the passageway plate 204, and raised surface section B' of the drive plate 206 is opposed to the flat surface section A of the passageway plate 204. As best shown in FIGS. 6A through 6C, the drive plate 206 is mounted at the terminal open end E2 of the housing 205 and fastened to the housing 205 by bolts (not shown). A circular rim section RS2 surrounds a central opening CO2, and a series outer bolt-holes H5 along the rim section's perimeter encircle the inward facing drive cam surface S2. As shown in FIG. 6A, a series of inner bolt-holes H6 (FIG. 6B) surround and are adjacent the central opening CO2 inward of the bolt-holes H5 to enable a collar CR (FIG. 1A) to be bolted to the drive plate 206.

As shown best in FIG. 9A1, other surface features of the inward facing passageway cam surface S2 include four zones S2*a* through S2*d* separated by transitions surfaces CH1 through CH4. The transitions surfaces CH1 through CH4 extend from the central opening CO2 to an outer edge of the circular platform CP. The transitions surfaces are grouped in two pairs: the surfaces CH1 and CH4 are one pair, and the surfaces CH2 and CH3 are the other pair. Each pair is configured to provide smooth, continuous movement of the vanes as they ride over the surface S2.

Figure 4B:
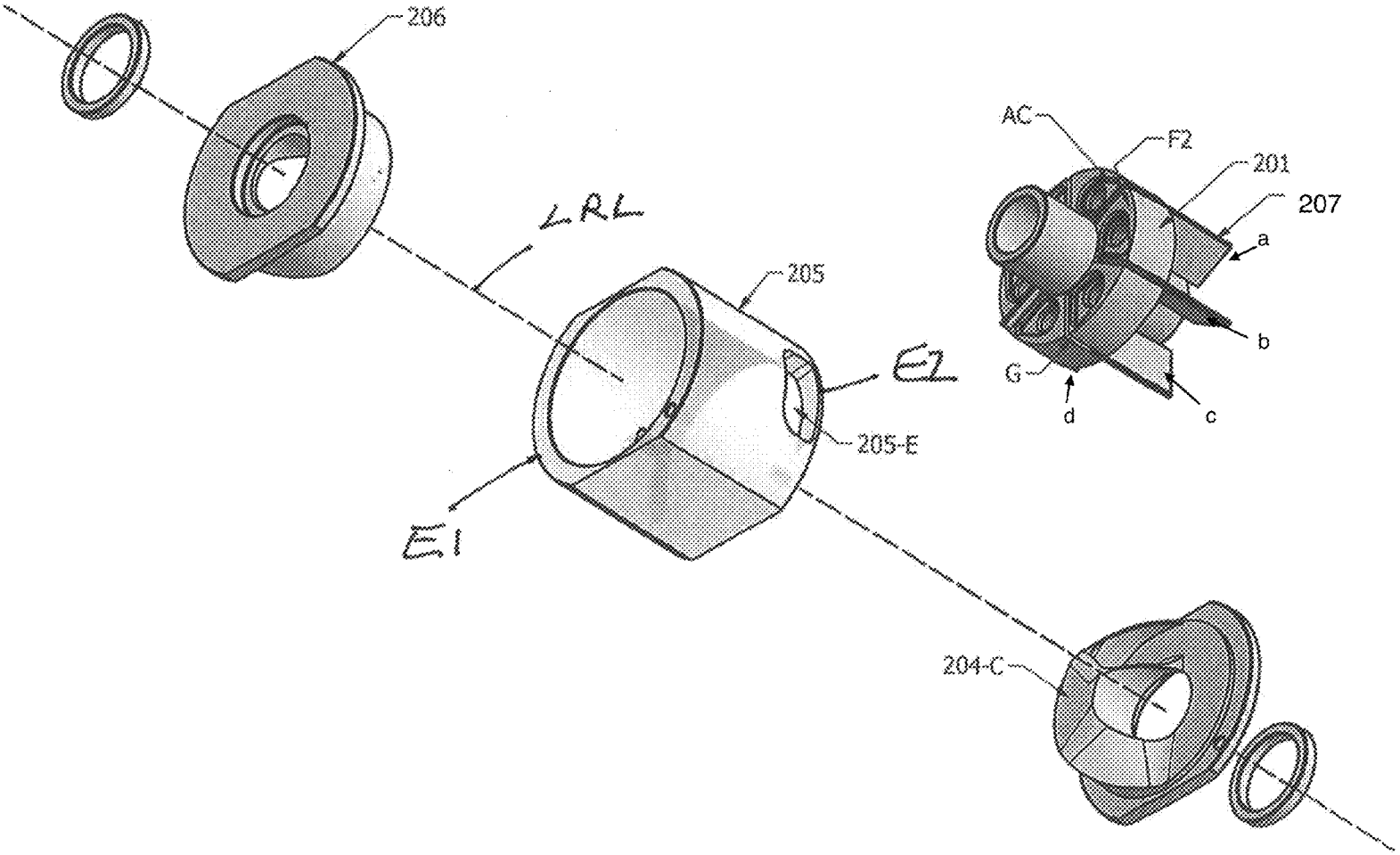
FIG. 4B is an exploded left hand perspective view of the embodiment of my pump shown in FIG. 2.
Figure 5:
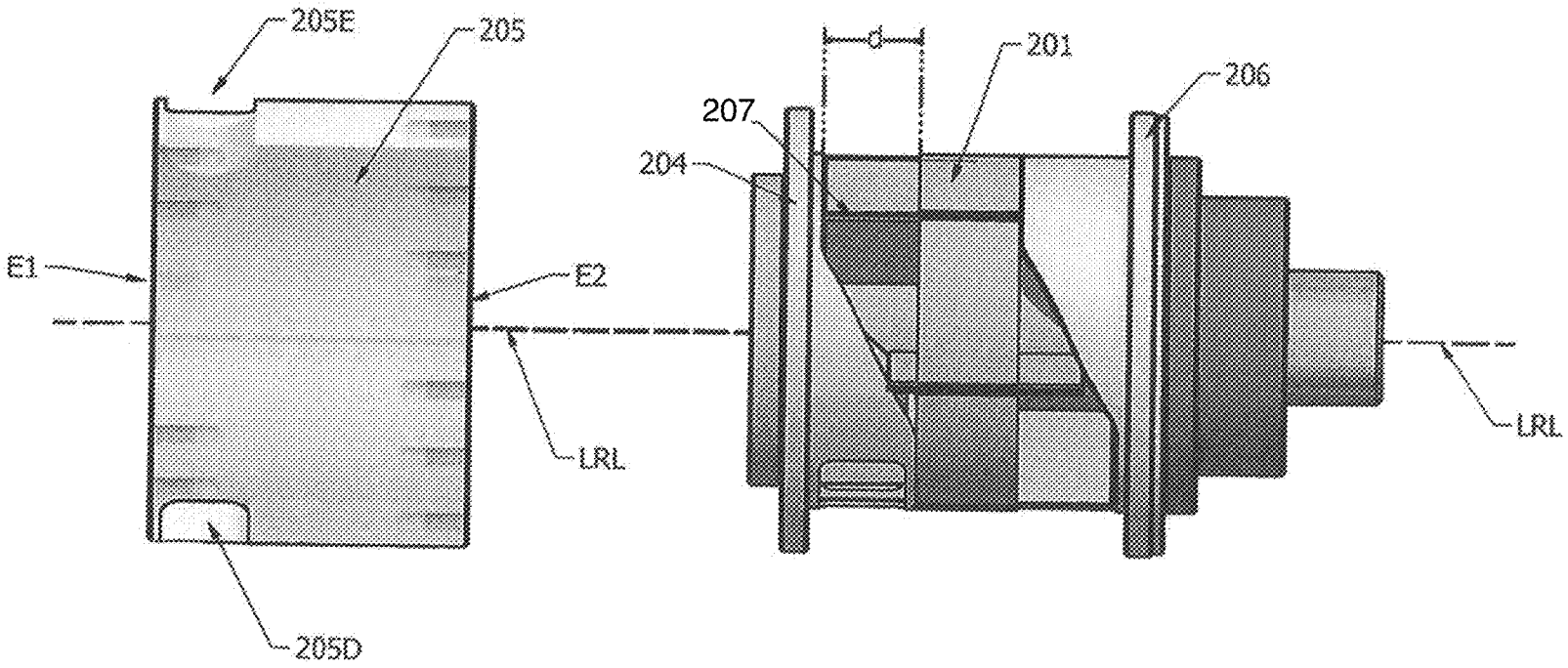
FIG. 5 is a top view of my pump shown in FIG. 1 depicting the housing detached from an assembly of a pair of end plates with a rotary member between the plates and mounted to rotate.

As shown best in FIGS. 4A and 4B, the rotor member 201 is generally circular shaped and has a hollow central mounting member 201*x* (FIG. 1A) through which the shaft 12 extends. A first side F1 of the rotor member faces the passageway cam surface S1 and an opposed second side F2 faces the drive cam surface S2. The rotor member 201 includes a plurality of arms 201*a* through 201*f* that extend radially from the central mounting member 201*x*. The radial arms 201*a* through 201*f* terminate in an arc shaped edge ED5 that forms the circular perimeter of the array of arms, and are positioned next to each other to form a narrow gap G between adjacent arms.

The vane elements 207 are individually mounted in a gap G between adjacent arms. of the array of arms 201*a* through 201*f* to move reciprocally within the gap G. Each vane element 207 is at a right angle to the opposed sides F1 (FIG. 4A) and F2 (FIG. 4B) is a thin, rigid, rectangular plate having opposed vane edges ED3 and ED4. The one edge ED3 engages the passageway cam surface S1 and the other edge ED4 engages the drive cam surface S2. The individual vane elements a-f are individually seated snugly in the individual gaps G and move laterally within the gaps by the action of the drive plate 206 pressing against the edge ED4 of the vane elements as the rotor member 201 rotates. The vane elements a-f divide the passageway P into a series of adjacent pie shaped chambers numbered 1 through 6 (FIGS. 9A1-9N2) that continually vary in volume as the rotor member 201 revolves and move the vane elements laterally and reciprocally.

There is a one-way check valve CV (FIG. 1A) in at least one of the radial arms 201 that opens in response to a predetermined elevated pressure of fluid material captured in an accumulation cavity AC in the second side F2 of the rotor member 201. A series of orifices OR in the radial arms 201*a* through 201*f* each have one terminal end in the side F1 of the rotor member 201 and another opposed terminal end in communication with an individual accumulation cavity AC through an individual check valve CV (only one shown), recycle to the passageway P fluid material leaking through the gaps G into the accumulation cavities AC. A vacuum is created as individual vane elements a-f pass the intake opening IO (discussed subsequently in greater detail in connection with FIGS. 9A1 through 9L2).

As the individual vane elements a-f move laterally and reciprocally, a series of equal sized pie shaped chambers 1 through 6 (FIG. 9A2) are being created. Chamber 1 is nearby the intake opening IO. When the rotor member 201 begins to rotate, the chamber 1 expands and is initially filled with fluid material flowing into the intake opening IO. This chamber 1 constantly expands from 0-volume to a maximum volume as the next vane element f moves into position, sucking the fluid material into the passageway P at the intake opening IO as the rotor member 201 continuously rotates. Continued rotation of the rotor member 201 results in the vane elements 207 pushing fluid material along the passageway P sequentially from chamber 1 through chamber 3 and then out the discharge opening DO.

The housing 205, plates 204 and 206, and rotor member 201, in assembly, form the passageway P between the passageway cam surface S1 and the first side F1 of the rotor member facing the passageway cam surface. The individual vane elements 207 identified by the letters a through f move laterally the distance d (FIG. 5) between the passageway cam surface S1 and the first side F1 of the rotor member 201. As the rotor member 201 rotates, the vanes elements 207 individually cover and uncover intake opening IO and discharge opening DO at opposed terminal ends of the passageway P.

As best depicted in FIG. 1A, a portion of the flat surface section A and the adjacent housing port 205-E are aligned. The housing 205 and passageway plate 204 are fastened together by bolts (not shown) into a configuration that provides the material intake opening IO into the passageway P. In the raised surface section B is a tunnel T (FIGS. 1A & 4A) extending there through and having a terminal opening 204-D nearby the second housing port 205-D. This terminal opening 204-D and second housing port 205-D are aligned. The housing 205 and passageway plate 204 are fastened together by bolts (not shown) into a configuration that provides a material discharge opening DO from the passageway P.

The collar CR holds the assembly of the housing 205, plates 204 and 206, and rotor member 201 in position on the shaft 12 with their centers lying along the longitudinal reference line LRL. Conventional bearings BR (FIG. 1) restrain and guide the drive shaft 12 as the shaft is driven by a hexagonal tool (not shown) inserted into a hexagonal cavity HC (FIG. 4A) in the shaft extending longitudinally along the reference line LRL. Removal of the end plate EP allows the tool to be inserted into the hexagonal cavity HC. The rotor member 201 is within the housing 205 between the passageway plate 204 and drive plate 206, and driven by the drive shaft to rotate as the hexagonal tool rotates the drive shaft.

Operation

As best shown in FIGS. 9A1 through 9L2, the vane elements 207 move laterally and reciprocally parallel to the longitudinal reference line LRL the short distance d (FIG. 5) between the passageway cam surface S1 and the first side F1 of the rotating rotor member 201. The chambers 1 through 3 form the passageway P. A leading portion LP of the individual elements a through f of the vane elements 207 is pushed away from a position covering the intake opening IO as its edge ED3 slides across the passageway cam surface S1. A trailing portion TP of the individual elements a through f of the vane elements 207 is concurrently pushed into chambers 4 through 6 forming empty spaces into which this trailing portion TP is received sequentially as the rotor member 207 continuously rotates. This action is illustrated in seven (7) steps:

Step 1 FIGS. 9A1 and 9A2, 9B1 and 9B2 showing the vane elements a-f in an initial position forming the chamber 1-6;

Step 2 FIGS. 9C1 and 9C2, 9D1 and 9D2 showing the rotor member 201 rotated 60 degrees to advance the vane elements a-f into their second position in the cycle;

Step 3 FIGS. 9E1 and 9E2, 9F1 and 9F2 showing the rotor member 201 rotated 120 degrees to advance the vane elements a-f into their third position in the cycle;

Step 4 FIGS. 9G1 and 9G2, 9H1 and 9H2 showing the rotor member 201 rotated 180 degrees to advance the vane elements a-f into their forth position in the cycle;

Step 5 FIGS. 9I1 and 9I2, 9J1 and 9J2 showing the rotor member 201 rotated 240 degrees to advance the vane elements a-f into their fifth position in the cycle;

Step 6 FIGS. 9K1 and 9K2, 9L1 and 9L2 showing the rotor member 201 rotated 300 degrees to advance the vane elements a-f into their sixth position in the cycle;

Step 7 FIGS. 9M1 and 9M2, 9N1 and 9N2 showing the rotor member 201 rotated 360 degrees to advance the vane elements a-f into their seventh and final position in the cycle;

Scope of the Invention

The above presents a description of the best mode I contemplate of carrying out my pump, and of the manner and process of making and using it in such full, clear, concise, and exact terms as to enable a person skilled in the art to make and use. My pump is, however, susceptible to modifications and alternate constructions from the illustrative embodiment discussed above which are fully equivalent. Consequently, it is not the intention to limit my pump to the particular embodiment disclosed. On the contrary, my intention is to cover all modifications and alternate constructions coming within the spirit and scope of my pump as generally expressed by the following claims, which particularly point out and distinctly claim the subject matter of my invention:

The invention claimed is:

1. A pump for fluid material including a drive shaft, a housing with opposed open ends, a passageway plate mounted at one of the open ends and including an inward facing passageway cam surface, a drive plate mounted at the other of the open ends and including an inward facing drive cam surface, a rotor member including a plurality of radial arms, said rotor member within the housing between said passageway plate and said drive plate and connected to and driven by the drive shaft to rotate as the drive shaft rotates, said rotor member having opposed first and second sides, the first side facing the passageway cam surface and the second side facing the drive cam surface, an accumulation cavity in the second side of the rotor member, said housing, said passageway plate and said drive plate, and said rotor member in assembly together forming a passageway having one end configured to provide a material intake opening and an opposed end configured to provide a material discharge opening, a vane element received in a gap defined in the rotor member and including opposed vane edges with one of the opposed vane edges engaging the passageway cam surface and the other of the opposed vane edges engaging the drive cam surface, said vane element configured to slide laterally and move reciprocally in the gap as the opposed vane edges respectively engage the passageway cam surface and the drive cam surface, moving the fluid material along the passageway from the material intake opening to the material discharge opening, a one-way check valve in at least one of the plurality of radial arms that opens in response to a predetermined elevated pressure of fluid material captured in the accumulation cavity, recycling the fluid material at the predetermined elevated pressure to the passageway from the accumulation cavity.

2. The pump of claim 1 where said passageway cam surface is formed in part by a raised surface section having a downwardly sloping section that merges with a lower flat surface section, and said passageway cam surface and said drive cam surface having complimentary topographies that match, and that are positioned and oriented within the housing with respect to each other so that the raised surface section of the drive plate is opposed to the lower flat surface section of the passageway plate, and a tunnel forms a portion of the passageway and passes through the raised surface section of said passageway cam surface and has a terminal end at the material intake opening and another terminal end between the material intake opening and the material discharge opening.

* * * * *